US009945377B2

(12) United States Patent
Pippes et al.

(10) Patent No.: US 9,945,377 B2
(45) Date of Patent: Apr. 17, 2018

(54) MOTOR-PUMP UNIT

(71) Applicant: Eckerle Industrie-Elektronik GmbH, Malsch (DE)

(72) Inventors: Reinhard Pippes, Bretten-Sprantal (DE); Dominik Ketterer, Ubstadt-Weiher (DE)

(73) Assignee: Eckerle Industrie-Elektronik GmbH, Malsch (DE)

( * ) Notice: Subject to any disclaimer, the term of this patent is extended or adjusted under 35 U.S.C. 154(b) by 481 days.

(21) Appl. No.: 14/664,327

(22) Filed: Mar. 20, 2015

(65) Prior Publication Data

US 2015/0267701 A1 Sep. 24, 2015

(30) Foreign Application Priority Data

Mar. 21, 2014 (DE) ..... 10 2014 103 958

(51) Int. Cl.

| | |
|---|---|
| ***F04C 2/10*** | (2006.01) |
| ***F04C 15/00*** | (2006.01) |
| ***F04C 14/26*** | (2006.01) |
| ***F04C 2/08*** | (2006.01) |
| ***F04C 18/10*** | (2006.01) |

(Continued)

(52) U.S. Cl.

CPC ..... *F04C 14/265* (2013.01); *F01C 21/108* (2013.01); *F04B 17/03* (2013.01);

(Continued)

(58) Field of Classification Search

CPC .. F04C 2/10; F04C 2/101; F04C 2/102; F04C 14/04; F04C 15/0019; F04C 15/0026

See application file for complete search history.

(56) References Cited

U.S. PATENT DOCUMENTS 3,486,459 A * 12/1969 Eltze ..... F04C 2/101 418/126
5,032,069 A * 7/1991 Parsons ..... F04C 2/101 418/159

(Continued)

FOREIGN PATENT DOCUMENTS

| | | |
|---|---|---|
| DE | 19854155 | 6/1999 |
| DE | 19930911 | 7/2000 |

(Continued)

OTHER PUBLICATIONS

European Search Report in Corresponding European Application No. 15 158 368.9, dated Sep. 29, 2015.

*Primary Examiner* — Peter J Bertheaud

(74) *Attorney, Agent, or Firm* — Edell, Shapiro & Finnan LLC

(57) ABSTRACT

A motor pump unit comprises an electric motor and a reversible internal gear machine. The latter has a multi-part housing in which an externally toothed pinion and an internally toothed hollow gear are arranged. A free space, in which a multi-part filler element is arranged, is configured between the gears. The filler element comprises radially movable sealing segments, between which a radial gap is configured. An axially movable sealing plate is arranged between axial faces of the gears and a housing part. This has a sealing plate control groove that is open to the faces of the gears and that can be pressurized, and which is open to the radial gap and located directly opposite thereto. The pinion segment and/or hollow gear segment has a radial sealing segment control channel that can be pressurized and extends transversely, is open to the radial gap, and ends directly in the radial gap.

4 Claims, 8 Drawing Sheets

(51) Int. Cl.

| | |
|---|---|
| ***F04C 27/00*** | (2006.01) |
| ***F04C 28/04*** | (2006.01) |
| ***F04C 28/26*** | (2006.01) |
| ***F04B 17/03*** | (2006.01) |
| ***F01C 21/10*** | (2006.01) |
| *F04C 14/04* | (2006.01) |

(52) U.S. Cl.

CPC ..... *F04C 2/084* (2013.01); *F04C 2/101* (2013.01); *F04C 15/0019* (2013.01); *F04C 15/0026* (2013.01); *F04C 18/103* (2013.01); *F04C 27/004* (2013.01); *F04C 27/006* (2013.01); *F04C 28/04* (2013.01); *F04C 28/265* (2013.01); *F04C 14/04* (2013.01)

(56) References Cited

U.S. PATENT DOCUMENTS

| | | | | |
|---|---|---|---|---|
| 6,183,229 | B1 * | 2/2001 | Friedmann | F04C 2/101 418/170 |
| 6,425,747 | B2 * | 7/2002 | Buchmuller | F04C 2/101 418/126 |
| 6,450,792 | B1 * | 9/2002 | Eisenbacher | F01C 21/108 418/170 |
| 6,659,748 | B1 * | 12/2003 | Arbogast | F04C 2/101 418/126 |
| 7,331,775 | B2 * | 2/2008 | Arbogast | F04C 2/101 418/169 |
| 9,039,398 | B2 * | 5/2015 | Schepp | F04C 2/101 418/126 |
| 9,470,227 | B2 * | 10/2016 | Ambrosi | F04C 2/102 |
| 9,481,347 | B2 * | 11/2016 | Schepp | F04C 2/086 |

FOREIGN PATENT DOCUMENTS

| | | |
|---|---|---|
| DE | 10211865 | 9/2002 |
| DE | 102008053318 | 4/2010 |
| DE | 10200947643 | 6/2011 |
| DE | 202012104839 | 1/2013 |
| DE | 102012001462 | 7/2013 |
| EP | 1760315 | 3/2007 |

* cited by examiner

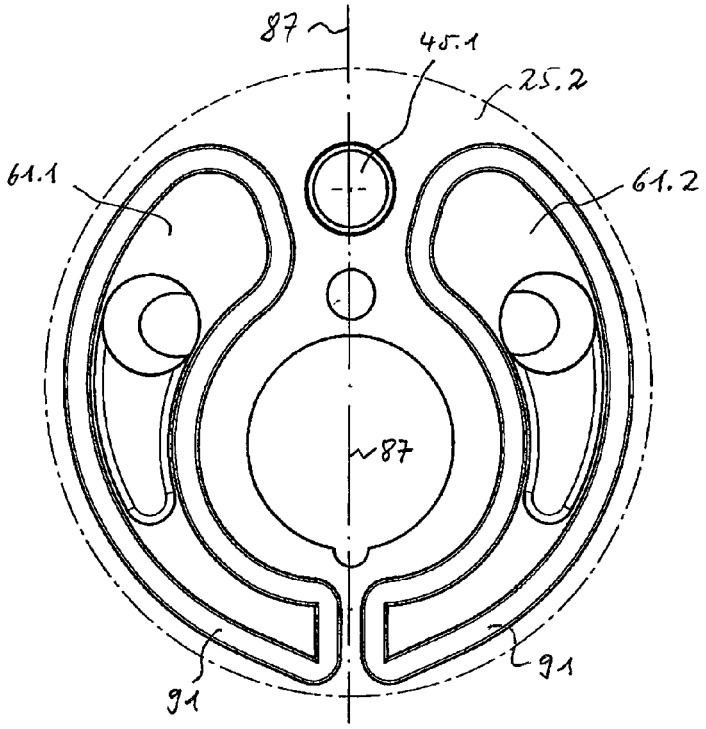
Fig. 7
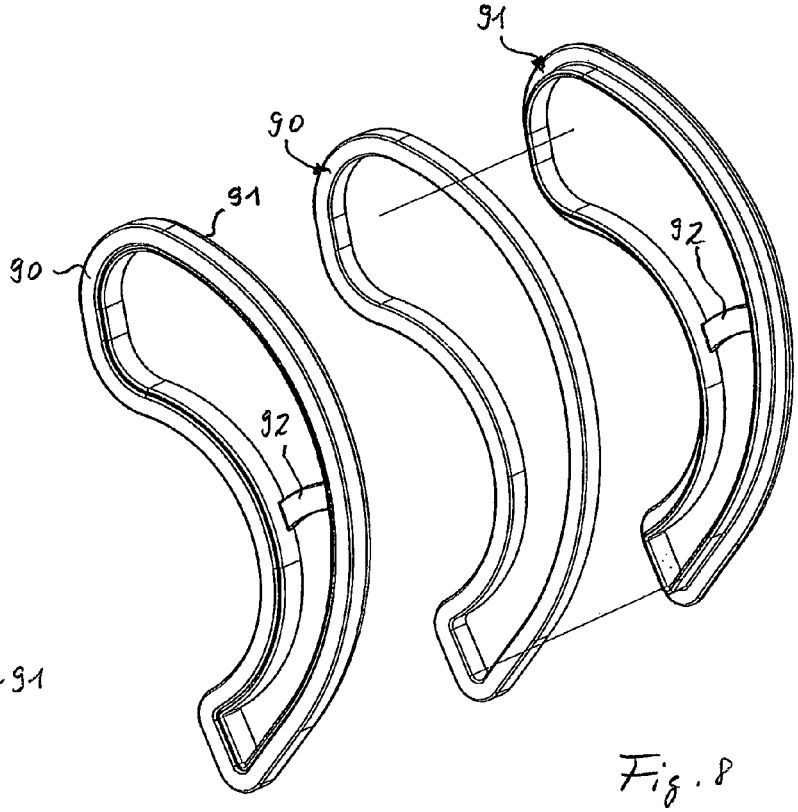
Fig. 8
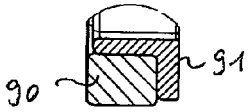
Fig. 10
Fig. 9

20
25.7
128
122.2
25.4
25.5
25.6
123
124
132
126
125
25.6
114
25.3
140
133
22.1
133.2
146.1
106
147
143.1
149
25.2
30
145.1
26
61.1
101.1
58.1
148
154.1
99
25.2
143.1
30
105.1
34.2, 35
26
105.2
25.1
145.2
154.2
143.2
144.2
146.2
106
133.5
22.2
25
140
34.1
141
111
144.1
144.1
144

MOTOR-PUMP UNIT

CROSS REFERENCE TO RELATED APPLICATIONS

This application claims foreign priority under 35 U.S.C. § 119(a)-(d) to Application No. DE 102014103958.0 filed on Mar. 21, 2014, the entire contents of which are hereby incorporated by reference.

FIELD OF THE INVENTION

The invention relates to a motor pump unit comprising an internal gear machine for reverse operation and an electric motor, which is coupled via a shaft to the internal gear machine.

BACKGROUND

An internal gear machine can be or is preferably driven optionally or depending on the direction of rotation as an internal gear pump by means of the electric motor or the electric motor can be or is driven as a current generator by means of the internal gear machine. A motor pump unit such as this can be used, for example, to drive a highly dynamic hydraulic axis.

What matters in such motor pump units is a high dynamic, low noise and pulsation level, recoverability, long service life, freedom from leaks, long service life and insensitivity to shock, dirt, and water, in particular salt water, and temperature, in particular cold.

In the motor pump units known until now, a drop in conveyance of pressurizing medium and consequently a strong discontinuity of the pressurizing medium volume flow can occur in the highly dynamic reverse operation during the respective reversal of direction of rotation.

SUMMARY

It is an object of the invention to prevent these disadvantages. This object is attained by means of the features of claim 1.

According to a further development it can be provided that the pinion segment and/or the hollow gear segment has a sealing roller groove that extends in the axial direction, in which is arranged a sealing roller that can be moved in the radial direction relative to the pinion segment and the hollow gear segment in order to seal the radial gap between the pinion segment and the hollow gear segment, and the pinion segment and/or the hollow gear segment has a segment spring groove that extends in the axial direction, which is arranged offset at a peripheral distance from the sealing roller groove in the direction of a pinion segment end of the pinion segment or hollow gear segment end of the hollow gear segment allocated to the high pressure area, wherein a preloaded spring is arranged in the segment spring groove, by means of which the hollow gear segment and the pinion segment are pressed away from each other in the radial direction in such a way that the pinion segment abuts against pinion teeth of the pinion teeth of the pinion with a radially inwardly facing outer surface and the hollow gear segment abuts against hollow gear teeth of the hollow gear teeth of the hollow gear with a radially outwardly facing outer surface, which faces away from the outer surface of the pinion segment, and/or the pinion segment is configured as segment carrier for the hollow gear segment and has a stop with a stop surface extending in the axial direction as well as radially outwardly toward the hollow gear to support the hollow gear segment and prevent a retraction into the area where the teeth engage during operation of the internal gear machine, wherein the stop is arranged offset with its stop surface at a peripheral distance from the segment spring groove in the direction of the pinion segment end of the pinion segment allocated to the high pressure area or the hollow gear segment is configured as a segment carrier for the pinion segment and has a stop with an axial stop surface that extends in the axial direction as well as radially inwardly toward the pinion to support the pinion segment and prevent a retraction into the area where the teeth engage during operation of the internal gear machine, wherein the stop is arranged offset with its stop surface at a peripheral distance from the segment spring groove in the direction of the hollow gear segment end of the hollow gear segment allocated to the high pressure area.

According to an advantageous further development it can be provided that the sealing plate control channel is configured as a sealing plate control groove.

According to a particularly advantageous embodiment variant it can be provided that the sealing plate control channel has a V-shaped cross section when observed in a cross section running parallel to the axial direction.

It can be particularly advantageous if the sealing plate control channel extends along the radial slot and/or the sealing plate control channel extends in the peripheral direction.

According to a particularly preferred embodiment it can be provided that the sealing plate control channel has a control channel length over which it is open to the radial slot and is directly opposite to the radial slot over its total control channel length.

According to a very particularly preferred embodiment variant it can be provided that the sealing plate control channel ends in a preferably pocket-shaped sealing plate recess, in particular a sealing pocket, of the axial sealing plate, which is basically arranged in the high pressure area that can be pressurized with pressurizing medium, and is open to the same sides of the axial faces of the gears allocated to the gears and is located directly opposite thereto, so that the sealing plate control channel can be directly pressurized with pressurizing medium via the sealing plate recess. The sealing plate recess can also be called sealing plate control recess.

It can be particularly preferably provided that the sealing plate control channel extends along the radial slot, preferably in the peripheral direction, starting from the sealing plate recess.

According to a particularly preferred embodiment it can be provided that the sealing plate control channel extends, preferably in the peripheral direction, starting from the sealing plate recess, either along the radial slot up into an area located directly opposite to the segment spring groove or along the radial slot and the segment spring groove, directly opposite to the segment spring groove, up into an area that is either arranged between the segment spring groove and the sealing roller groove or reaches up to the sealing roller groove or is located directly opposite the sealing roller groove.

According to a particularly preferred embodiment variant it can be provided that the radial sealing segment control channel extends in a direction or peripheral direction, in which the pinion can be rotated around its pinion rotational axis or the hollow gear can rotate around its hollow gear rotational axis and/or the radial sealing segment control channel extends in a direction or peripheral direction running transversally or perpendicularly to the axial direction of an imaginary plane.

According to a preferred embodiment variant it can be provided that the radial sealing segment control channel is designed as a chamfer or as a groove or that at least one first radial sealing segment control channel is designed as a chamfer and at least one second radial sealing segment control channel is designed as a groove.

According to a particularly advantageous embodiment it can be provided that the radial sealing segment control channel extends between the segment spring groove and the sealing roller groove and/or that the radial sealing segment control channel ends in the segment spring groove and/or in the sealing roller groove and/or that the radial sealing segment control channel extends between the segment spring groove and the stop surface of the stop and/or that the radial sealing segment control channel extends up to the stop surface of the stop and/or that the radial sealing segment control channel extends over or beyond the stop surface of the stop up to a free surface of the pinion segment and/or hollow gear segment located opposite the hollow gear teeth of the hollow gear teeth of the hollow gear.

According to a preferred further development it can be provided that the pinion segment and/or the hollow gear segment or the filler element is or are configured in a sickle shape.

According to an advantageous further development the pinion segment can be designed as one piece and/or be produced from one piece and/or the hollow gear segment can be designed as one piece and/or be produced from one piece.

According to a preferred embodiment it can be provided that the radial sealing segments comprise at least two or precisely two hollow gear segments and/or that the radial sealing segments comprise at least two or precisely two pinion segments.

According to a particularly preferred embodiment it can be provided that the pinion segment and/or the hollow gear segment is mounted to prevent displacement in the direction of a low pressure area or a suction side of the working chamber by means of at least one retaining pin, which is rotatably mounted in a housing part of the housing located opposite to one of the axial faces of the gears allocated to the same sides of the gears, wherein the retaining pin has a retaining element at its end allocated to the filler element, which retaining element has a V-shaped or trapezoidal cross section when observed in a cross section perpendicular to the axial direction and comprises retaining element support surfaces, which enclose an acute angle preferably amounting to 20 to 30 degrees or about 24 degrees, and wherein the pinion segment and/or the hollow gear segment has at least one sealing segment recess for receiving the retaining element of the at least one retaining pin, which sealing segment recess likewise comprises a V-shaped or trapezoidal cross section when observed in a cross section perpendicular to the axial direction and sealing segment support surfaces, which likewise enclose an acute angle preferably amounting to 20 to 30 degrees or about 24 degrees, and wherein the retaining element support surfaces as well as the sealing segment support surfaces extend in a wedge shape in the direction of a center to the pinion, and wherein the at least one retaining pin engages the at least one sealing segment recess with its retaining element.

According to a preferred embodiment variant at least two axial pressure fields can be provided in the form of recesses or depressions, which are provided in the at least one axial sealing plate and/or in the housing part located opposite to the at least one axial sealing plate on its side that faces away from the gears. According to a likewise preferred embodiment it can be provided that the at least one axial sealing plate has at least two control fields or pressure pockets in the form of recesses or depressions in its side that faces toward the faces of the gears.

According to a particularly preferred embodiment it can be provided that the filler element and/or the control fields or the pressure pockets of one or each axial sealing plate and/or the axial pressure fields and/or the at least one or each axial sealing plate is or are symmetrical to an imaginary symmetry plane that contains the pinion rotational axis and the hollow gear rotational axis.

According to a particularly preferred embodiment variant it can be provided that the electric motor is a brushless direct current motor (EC motor).

According to a particularly preferred embodiment it can be provided that the shaft is a motor pump shaft consisting of and/or made from one piece, on which the rotor is mounted torque-free, preferably friction locked, in particular by pressing or shrink fitting, and on which the pinion is mounted torque-free, preferably form-fitted, in particular releasably.

It is understood that the aforementioned features and provisions can be combined as desired within the scope of the practicability of the invention.

BRIEF DESCRIPTION OF THE DRAWINGS

Further features, advantages and viewpoints of the invention arise from the claims and the drawings as well as from the following descriptive part, in which a preferred exemplary embodiment of the invention is described with the aid of figures.

In the figures:

FIG. 7 shows a plan view of a housing part of the housing of the internal gear machine located opposite the side of the axial sealing plate that faces away from the teeth;

FIG. 8 shows a perspective view of an arrangement of a sealing ring and a support ring for the sealing ring in an exploded view;

FIG. 9 shows a perspective view of an arrangement in which the support ring and the sealing ring are plugged together in an installation position;

FIG. 10 shows an enlarged cutout of a cross section of the arrangement according to FIG. 9 along section lines 10-10;

DETAILED DESCRIPTION

Figure 1:
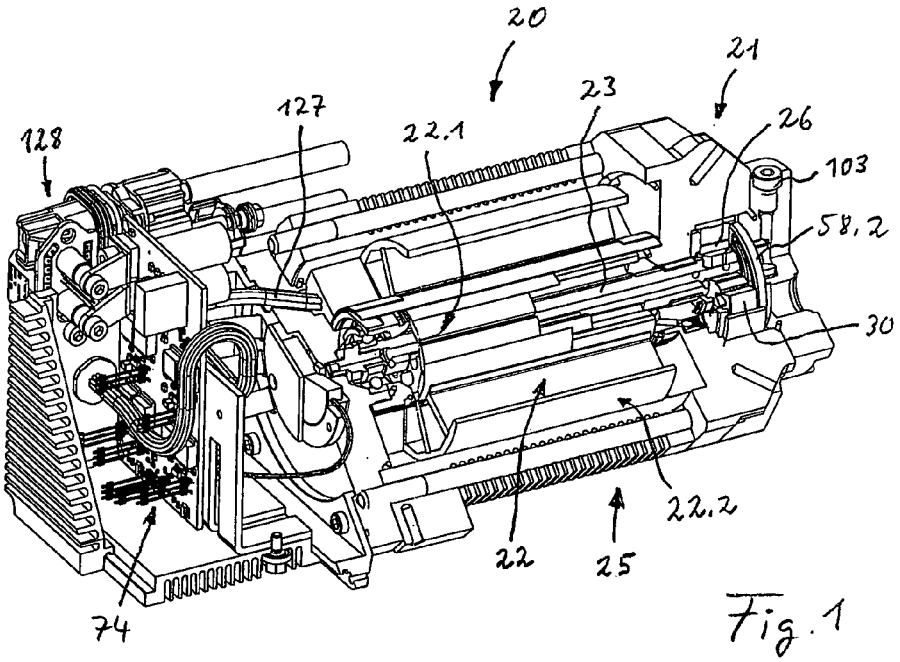
FIG. 1 shows a perspective view of a motor pump unit according to the invention.

The motor pump unit 20 comprises an internal gear machine 21 for reverse operation, an electric motor 22 and integrated electronics 74, in particular for speed control. The electric motor 22 comprises a rotor 22.1 and a stator 22.2. The rotor 22.1, which can be rotated around a rotor rotational axis 34.1 relative to the stator 22.2, is torque-proof connected to a shaft 23 that can be rotated around a shaft rotational axis 35. The rotor 22.1 is coupled to the gear mechanism of the internal gear machine 21 via the shaft 23. The shaft 23 is preferably a combined one-piece motor pump shaft. The motor pump shaft 23 is rotatably mounted around a shaft rotational axis 35 in the housing 25. The motor pump unit 20 can preferably be used to energize a highly dynamic hydraulic axis, which is not shown in the figures.

Figure 3:
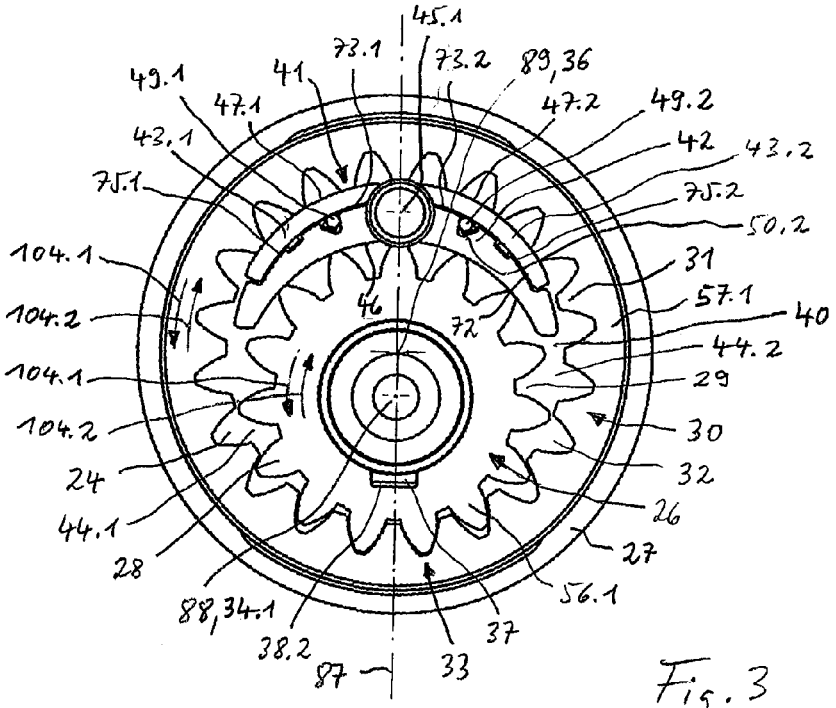
FIG. 3 shows a cross section of the internal gear machine of the motor pump unit along section lines 3-3 in FIG. 2.

The motor pump unit 20 comprises a multi-part housing 25, which contains the electric motor 22 as well as the internal gear machine 10. The rotor 22.1 as well as the stator 22.2 are arranged in a pipe-shaped housing part 25.3 of the housing 25 allocated to motor 22 in the shown exemplary embodiment. It is understood, however, that the stator could also be a component of a housing part of the housing of the motor pump unit or could be configured as a housing part of the housing of the motor pump unit. The internal gear machine 21 is a hydraulic machine in the form of a compensated four-quadrant internal gear machine 21. The motor pump unit 20 is preferably used in a closed hydraulic system. The motor pump unit 20 is characterized by a high dynamic, low noise and pulsation level, recoverability, long service life, absolute freedom from leaks, lifetime fill of the system, insensitivity to shock and to dirt, water, in particular salt water, and temperature, in particular cold. The motor pump unit 20 has especially the following design features for this purpose:

Internal Gear Machine:

A hydraulic pump in the form of an internal gear pump with axial and radial sealing gap compensation is used as internal gear machine 21. The internal gear machine 21 comprises a working chamber 24, which is delimited by preferably two housing parts 25.1 and 25.2 of the housing 25 of the motor pump unit 20. Two gears 26, 30 are arranged in the housing 25 or in the working chamber 24. These are an externally toothed pinion 26 having pinion teeth 28 and an internally toothed hollow gear 30 having hollow gear teeth 31. The hollow gear 30 is eccentrically mounted in a mounting ring 27 with reference to the pinion 26. The mounting ring 27 is torque-proof connected, preferably pressed into the housing part 25.2 of the housing 25. The hollow gear 30 is arranged in such a way that hollow gear teeth of the hollow gear teeth 31 of the hollow gear 30 mesh with pinion teeth of the pinion teeth 28 of the pinion 26 in an area 33 where the teeth engage. The pinion 26 is rotatably mounted around a pinion rotational axis 34.2. The pinion rotational axis 34.2 is coaxially arranged with respect to the shaft rotational axis 35 of the shaft 23. The hollow gear 30 is rotatably mounted around a hollow gear rotational axis 36. The directions of rotation of the pinion 26 and the hollow gear 30 are the same. This means that if, for example, the pinion 26 rotates in a clockwise direction, and then the hollow gear 30 must also necessarily rotate in a clockwise direction. The pinion 26 is preferably releasably connected to the shaft 23, for example, via a feather key 37, which form-fittingly engages matching grooves 38.1, 38.2 of the shaft 23 as well as of the pinion 26 (refer to FIG. 3). The pinion 26 and the shaft 23 are consequently form-fittingly torque-free connected to each other. The hollow gear rotational axis 36 and the pinion rotational axis 34.2 extend parallel to each other in an axial direction 39.

A sickle-shaped free space 40 of the working chamber 24 is configured between the pinion 26 and the hollow gear 30. A multi-part sickle-shaped filler element 41 is arranged in the free space 40. The filler element 41 comprises several radial sealing segments 42; 43.1, 43.2 that can move relative to each other in the radial direction in order to radially seal the "active" high pressure area 44.1, 44.2 of the working chamber 24, which is respectively dependent on the direction of rotation 104.1, 104.2. The high pressure area 44.1, 44.2 is allocated to the area of the working chamber 24 which, starting from a pressure buildup area of the working chamber 24, during operation of the internal gear machine 21 corresponds approximately to the area in which the teeth 28, 31 of the gears 26, 30 reach the filler element 41 or the area of the filler element 41, in which at least one, preferably two, retaining pin(s) or retaining bolt(s) 45.1, 45.2 for the filler element 41 or its radial sealing segments 42; 43.1, 43.2 is arranged, in which the respective direction of rotation 104.1, 104.2 extends up to the area 33 where the teeth engage, in which the teeth 28, 31 of the gears 26, 30 mesh with each other, when observed from the pinion 26 or the hollow gear 30. The respective active high pressure area 44.1, 44.2 is configured in a half-sickle or pocket shape. If the internal gear pump 21 rotates in its first operating direction in which the pinion 26 and the hollow gear 30 rotate in their first direction of rotation 104.1, a high fluid pressure is built up in a first area 44.1 of the working chamber 24, which is then the active first high pressure area 44.1. In contrast thereto, a low fluid pressure is built up in the second area 44.2 of the working chamber. If the internal gear pump 21 rotates in its second operating direction, which is opposite to the first operating direction, that is, the pinion 26 and the hollow gear 30 rotate in their second direction of rotation 104.2 opposite to the first direction of rotation 104.1, a high fluid pressure builds up in the second area 44.2 of the working chamber 24, which is then the active second high pressure area 44.2. In contrast to this, in the first area 44.1 of the working chamber a low fluid pressure builds up. A first connection channel 105.1 ends in said first area 44.1 of the working chamber 24 and a second connection channel 105.2 ends in said second area 44.2 of the working chamber (refer to FIG. 12). If consequently the internal gear pump 21 rotates in its first operating direction 104.1, for example, the first working channel 105.1 is pressurized with high fluid pressure, and if the internal gear pump 21 rotates in its second operating direction 104.2, the second working channel 105.2 is pressurized with a high fluid pressure of the fluid pressurizing medium. The first connection channel 105.2 and the second connection channel 105 preferably extend parallel to each other in the axial direction 39.

The radial sealing segments 42; 43.1, 43.2 comprise a first radial sealing segment, which also forms a pinion segment 42 that can be called segment carrier, and which can abut or abuts against pinion teeth of the pinion teeth 28 of the pinion 26. The pinion segment 42 is configured as one piece and/or produced from one piece, for example, by milling.

Moreover, the radial sealing segments 42; 43.1, 43.2 comprise at least one second radial sealing segment, which forms a hollow gear segment 43.1, 43.2 and can abut or abuts against hollow gear teeth of the hollow gear teeth 31 of the hollow gear 30. The preferred exemplary embodiment shown in the figures provides two separate hollow gear segments 43.1, 43.2, of which each hollow gear segment 43.1, 43.2 can abut or abuts against hollow gear teeth of the hollow gear teeth 31 of the hollow gear 30. The pinion segment 42 has an inner surface 72 that faces radially outwardly toward the respective hollow gear segment 43.1, 43.2 in the area of each hollow gear segment 43.1, 43.2. Each hollow gear segment 43.1, 43.2 has an inner surface 73.1, 73.2 that faces radially inwardly toward the pinion segment 42, which is located opposite the allocated inner surface 72 of the pinion segment 42. A radial gap 75.1, 75.2 is configured in each case between the inner surface 72 of the pinion segment 42 and the inner surface 73.1, 73.2 of the respective hollow gear segment 43.1, 43.2. Pressurizing medium, preferably pressure oil, arrives in said radial gap 75.1, 75.2 or in the corresponding space, which is also called a compensation chamber, from the active high pressure area 44.1, 44.2 allocated to the current direction of rotation of the pinion 26 and the hollow gear 30 during operation of the internal gear machine 21. One of the two hollow gear segments 43.1, 43.2, namely the hollow gear segment 43.1, 43.2 allocated to the current or active high pressure chamber 44.1, 44.2, which can then be called an active hollow gear segment, and the pinion segment 42 are pressed away from each other or apart, so that the pinion segment 42 sealingly presses with an outer surface 46 against tooth heads of pinion teeth of the pinion teeth 28 of the pinion 26 and additionally the active hollow gear segment 43.1, 43.2 sealingly presses with an outer surface 47.1, 47.2 against teeth heads of hollow gear teeth of the hollow gear teeth 31 of the hollow gear 30, so that said radial gap 75.1, 75.2 is radially compensated in this way. In this connection one then speaks of radial compensation or a radially compensated internal gear machine 21.

In the shown exemplary embodiment, the pinion segment 43.1, 43.2 has two sealing roller grooves 48.1, 48.2 extending in the axial direction 39. Each sealing roller groove 48.1, 48.2 is open to its axial ends that mutually face away from each other. For sealing the radial gap 75.1, 75.2 between the pinion segment 42 and the respective hollow gear segment 43.1, 43.2, a sealing roller 49.1, 49.2 that can be moved in the radial direction relative to the pinion segment 42 and the respectively allocated hollow gear segment 43.1, 43.2 is arranged in each sealing roller groove 48.1, 48.2. A preloaded sealing roller spring 50.1, 50.2, preferably a leaf spring, can also be arranged in each sealing roller groove 48.1, 48.2. Each sealing roller spring 50.1, 50.2 is supported, on the one hand, on a groove base of the allocated sealing roller groove 48.1, 48.2 and, on the other hand, on the allocated sealing roller 49.1, 49.2. Each sealing roller 49.1, 49.2 is also pressed against a sealing surface of the sealing roller groove 48.1, 48.2 of the pinion segment 42 and also against a sealing surface of the respectively allocated hollow gear segment 43.1, 43.2 in the non-pressurized state or when the internal gear machine 21 is not in operation.

The pinion segment 42 furthermore has two segment spring grooves 51.1, 51.2 extending in the axial direction 39. Each segment spring groove 51.1, 51.2 is open to its axial ends that face mutually away from each other. A preloaded spring 51.1, 52.2, preferably a leaf spring, is accommodated in each segment spring groove 51.1, 51.2. Each segment spring groove 51.1, 51.2 is arranged offset in the peripheral direction at a peripheral distance or peripheral angle from the respectively allocated sealing roller groove 48.1, 48.2, specifically offset in the direction of a pinion segment end 53.1, 53.2 of the pinion segment 42 allocated to the high pressure area 44.1, 44.2 that is dependent on the direction of rotation. The allocated hollow gear segment 43.1, 43.2 and the pinion segment 42 are pressed away from each other or apart in the radial direction by means of this spring 52.1, 52.2 in such a way that the pinion segment 42 sealingly abuts against hollow gear teeth of the hollow gear teeth 31 of the hollow gear 30 with a radially inwardly facing outer surface 46 and the hollow gear segment 43.1, 43.2 sealingly abuts against hollow gear teeth of the hollow gear teeth 31 of the hollow gear 30 with a radially outwardly facing outer surface 47.1, 47.2, which faces away from the outer surface 46 of the pinion segment 42.

The pinion segment 42 is configured as a segment carrier for the respective hollow gear segment 43.1, 43.2 and has a stop 54.1, 54.2, which can also be called a stop pocket, for each hollow gear segment 43.1, 43.2. Each stop 54.1, 54.2 has a stop surface 55.1, 55.2 extending in the axial direction 39 as well as radially outwardly to the hollow gear 30 for support of the respective hollow gear segment 43.1, 43.2 against a retraction of the respective hollow gear segment 43.1, 43.2 into the area 33 where the teeth engage during operation of the internal gear machine 21. Each stop 54.1, 54.2 is arranged offset with its stop surface 55.1, 55.2 at a peripheral distance or at a peripheral angle from the respective segment spring groove 51.1, 51.2 in the peripheral direction in the direction of the pinion segment end 53.1, 53.2 of the pinion segment 42 allocated to the active high pressure area 44.1, 44.2, which is dependent on the direction of rotation.

Two axial sealing plates 58.1, 58.2, which can move in the axial direction 39, are provided in the exemplary embodiment for axial compensation of the respective axial gap between the respective faces 56.1, 56.2; 57.1, 57.2 of the gears 26, 30, which faces face in the same direction or are allocated to the same sides of the gears 26, 30 and the respective housing part 25.1, 25.2. They serve to bring about the sealing of the high pressure area 44.1, 44.2 of the working chamber 24, which is dependent on the direction of rotation of the gears 26, 30. The axial sealing plates 58.1, 58.2 can also be called axial washers. It is understood that just one single axial sealing washer can be provided. The or each axial sealing washer 58.1, 58.2 is arranged between the respectively allocated faces 56.1, 56.2; 57.1, 57.2 of the gears 26, 30 and a housing part 25.1, 25.2 of the housing 25.

The or each axial sealing washer 58.1, 58.2 is pressed by means of pressurizing medium under high pressure with its respective inner surface 59.1, 60.1 against the respectively allocated faces 56.1, 56.2; 57.1, 57.2 of the pinion 26 and hollow gear 30 during operation of the internal gear machine 21. So-called pressure fields 61.1, 61.2, which can also be called axial fields, are provided for this purpose (refer to FIG. 7). The pressure fields 61.1, 61.2 form control fields. The pressure fields 61.1, 61.2 are provided in the form of recesses in the respectively allocated housing part 25.1, 25.2 of the housing 25 in this exemplary embodiment. However, it is understood that the pressure fields or a pressure field allocated to an axial sealing plate can also be provided in the form of a recess in the axial sealing plate or in the respective axial sealing plate. The or each pressure field 61.1, 61.2 is configured in the shape of a pocket.

Figure 4:
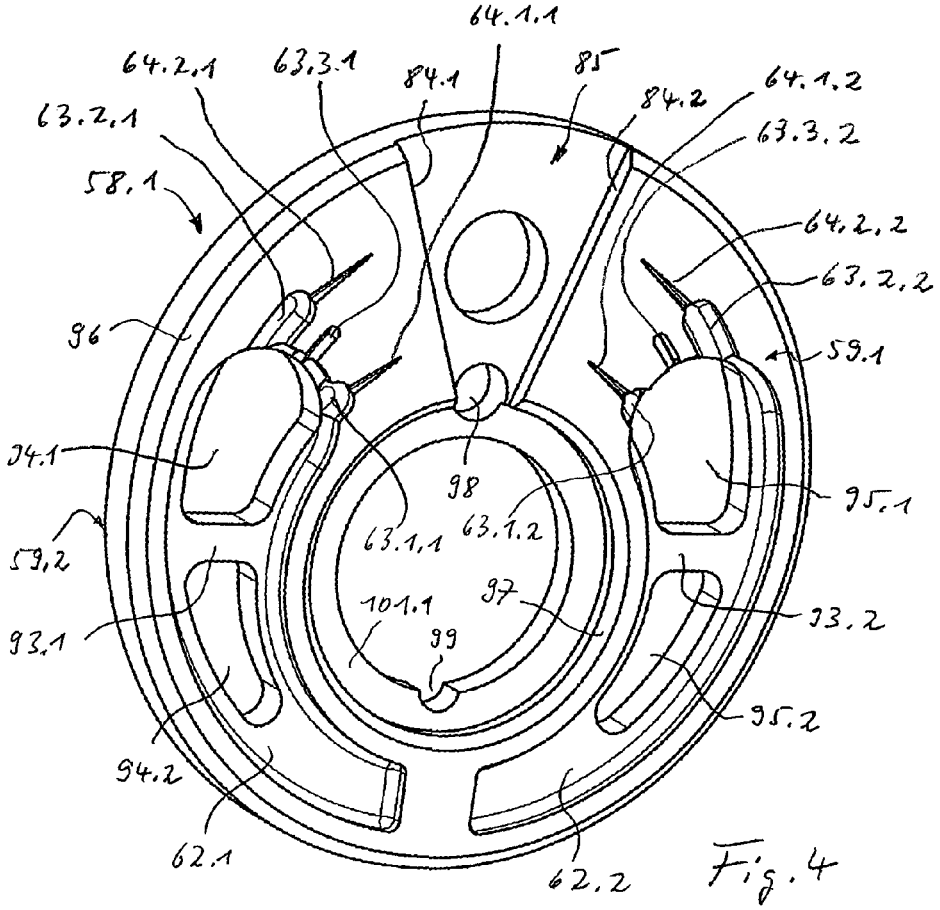
FIG. 4 shows a perspective view of an axial sealing plate of the internal gear machine.
Figure 5:
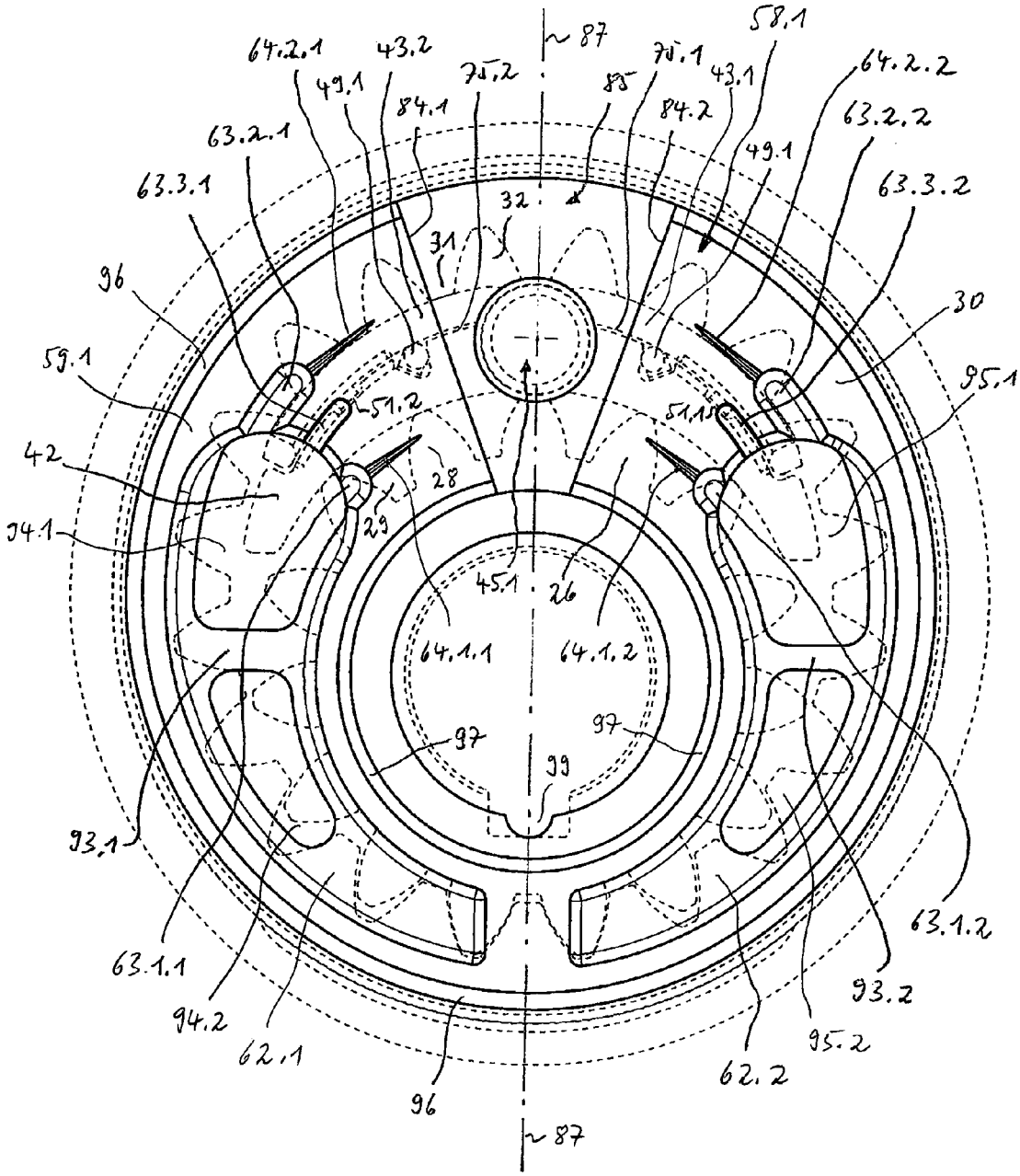
FIG. 5 shows a plan view of the axial sealing plate according to FIG. 4, wherein the machine elements according to the view of FIG. 3 are drawn with dotted lines in order to depict the position and arrangement of the elements with respect to each other.
Figure 6:
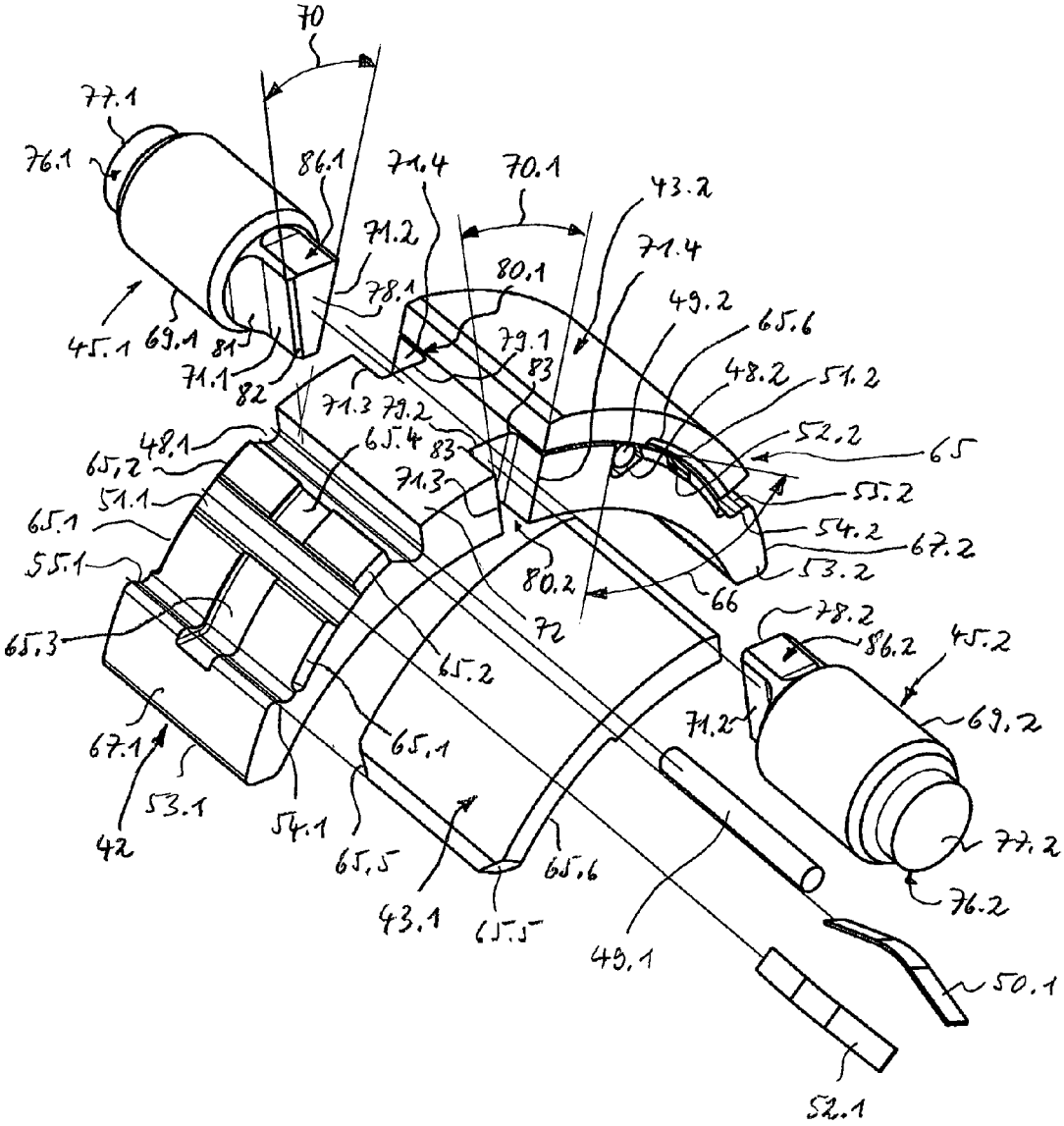
FIG. 6 shows a perspective view of the components that form and support the filler element in an exploded view.

The axial washers 58.1, 58.2 have pocket-shaped control fields 62.1, 62.2, which are also called sealing plate recesses or pressure pockets (refer to FIGS. 4 and 5), on their inner sides 59.1, 60.1, that is, the sides that face the pinion 26 and the hollow gear 30. They are recesses or depressions in the respective axial washer 58.1, 58.2. These control fields 62.1, 62.2 can be pressurized under high pressure with pressurizing medium just like the pressure fields 61.1, 61.2 or are pressurized with pressurizing medium of the respective high pressure area 44.1, 44.2 during operation of the internal gear machine 21. A counteracting force can be produced in this way, which counteracts the force of the pressure fields 61.1, 61.2. Two control grooves 63.1.1, 63.1.2; 63.2.1, 63.2.2, which are respectively open to the allocated faces 56.1, 56.2; 57.1, 57.2 of the gears 26, 30, are allocated to each pressure pocket 62.1, 62.2, of which a first control groove 63.1.1, 63.1.2 is arranged in the area directly opposite the pinion teeth gaps 29 configured between the pinion teeth 28 of the pinion 26 and a second control groove 63.2.1, 63.2.2 is arranged in the area directly opposite the hollow gear teeth gaps 32 configured between the hollow gear teeth 31 of the hollow gear 30 (refer to FIG. 5). The first control groove 63.1.1, 63.1.2 as well as the second control groove 63.2.1, 63.2.2, respectively, end with a first end in the allocated pressure pocket 62.1, 62.2. A control slot 64.1.1, 64.1.2; 62.2.1, 64.2.2 in the form of a recess or depression of the respective axial washer 58.1, 58.2 is provided at a respective second end of the first and second control groove 63.1.1, 63.1.2; 63.2.1, 63.2.2, which respectively faces away from the first end in the peripheral direction. Each control slot 64.1.1, 64.1.2; 62.2.1, 64.2.2 ends in the respectively allocated first or second control groove 63.1.1, 63.1.2; 63.2.1, 63.2.2. Each control slot 64.1.1, 64.1.2; 62.2.1, 64.2.2 extends approximately or basically in the peripheral direction.

In addition to the preceding features, the motor pump unit 20 according to the invention or the internal gear machine 21 according to the invention additionally has the following features, among others, which are essential to the invention:

On its side or inner side 59.1, 60.1 that faces toward the faces 56.1, 56.2; 57.1, 57.2 of the gears 26, 30, the at least one axial sealing plate 58.1, 58.2 has at least one sealing plate depression or recess 63.3.1, 63.3.2, open to the faces 56.1, 56.2; 57.1, 57.2 of the gears 26, 30, in the form of an additional or third sealing plate control channel that can be pressurized with pressurizing medium and is configured as a sealing plate control groove. In the shown preferred exemplary embodiment it is a third control channel of three control channels, each of which ends in the pocket-shaped sealing plate recess or pressure pocket 62.1, 62.2 of the two sealing plate recesses or pressure pockets 62.1, 62.2 of each axial washer 58.1, 58.2, each of which is pressurized with pressurizing medium. Said additional or third sealing plate control channel 63.3.1, 63.3.2 is open to the allocated radial gap 75.1, 75.2 and is located directly opposite the allocated radial gap 75.1, 75.2 (refer to FIG. 5). The respective additional or third sealing plate control channel 63.3.1, 63.3.2 extends starting from the respective sealing plate recess or pressure pocket 62.1, 62.2 in the peripheral direction along the allocated radial gap 75.1, 75.2 between the pinion segment 42 and the allocated hollow gear segment 43.1, 43.2 up into an area located directly opposite the segment spring groove 51.1, 51.2. Said additional sealing plate control channel 63.3.1, 63.3.2 has no control slot in contrast to the respective first and second control groove 63.1.1, 63.1.2; 63.2.1, 63.2.2. The respective additional sealing plate control channel or the respective third control groove 63.3.1, 63.3.2 ensure that the necessary radial compensation pressure in the allocated radial gap 75.1, 75.2 between the pinion segment 42 and the respective active hollow gear segment 43.1, 43.2, and therefore a particularly advantageous seal is achieved almost at the same time as the respective reversal in the direction of rotation.

It is additionally provided in the internal gear machine 21 according to the invention that the pinion segment 42 and/or the hollow gear segment 43.1, 43.2 has at least one radial sealing segment depression in the form of a radial sealing segment control channel 65; 65.1, 65.2, 65.3, 65.4, 65.5, 65.6 extending in a peripheral direction around the pinion axis 34.2 or around the hollow gear axis 36, which can be pressurized with pressurizing medium, is open to the allocated radial gap 75.1, 75.2, and ends directly in the allocated radial gap 75.1, 75.2. The radial sealing segment control channel 65 preferably extends in a direction or in the direction of rotation in which the pinion 26 can rotate around its pinion rotational axis 34.2 or in which the hollow gear 30 can rotate around its hollow gear rotational axis (36) and/or the radial sealing segment control channel 65 extends in a direction located in an imaginary plane running perpendicularly to the axial direction 39. Pressurizing medium, preferably pressure oil, that builds up in the active pressure chamber 44.1, 44.2 can arrive faster in the space of the active radial gap 75.1, 75.2 as a result of the preceding provisions. The necessary radial compensation pressure, and therefore even better or optimal sealing, is achieved within a shorter time in this way in the active radial gap 75.1, 75.2 between the pinion segment 42 and the respective active hollow gear segment 43.1, 43.2 during the respective reversal of direction of rotation.

In addition to the preceding features, further provisions or features are provided in the internal gear machine 21 according to the invention, and these provisions or features have proven to be particularly advantageous for the above mentioned intended use. The demands placed on this motor pump unit 20 can thus be especially met in this way:

Gearing:

The requirement of a low noise and pulsation level is achieved by means of an especially designed involute gearing with 15 teeth 28 on the pinion 26 and 20 teeth 31 on the hollow gear 30. A higher teeth number would indeed produce a further reduction of the flow pulsation, but would simultaneously also increase the hollow gear diameter. This would mean more installation space and a reduction of the hydraulic-mechanical efficiency of the gear machine. Moreover, the production costs would increase. Aside from this, the mass moments of inertia of the gear pump would also increase due to the greater hollow gear diameter. A lower mass moment of inertia is decisive, however, for the energy efficiency of the motor pump unit 20 with high dynamic demands of up to 10 changes in direction of rotation per second.

Both the externally toothed pinion 26 and the internally toothed hollow gear 30 are profile shifted. The engagement angle is 25°. The tooth head height factor of the pinion teeth is 1.25 and the tooth head height factor of the hollow gear teeth is 1.24. This combination has proven to be extremely low in noise. The tooth head edges are especially shaped.

A low flank play (0.02 to 0.05 mm or 0.01 to 0.025× module) ensures that even in highly dynamic reverse operation, only a very little pressurizing medium, in particular pressure oil, can flow via the tooth meshing to the "suction side."

Radial Compensation:

The radial compensation is represented by means of three segment parts 42; 43.1, 43.2, which can also be called radial sealing segments. The one-piece pinion segment 42 actively seals in both directions of rotation during pump operation as well during motor operation. The two hollow gear segments 43.1, 43.2 only actively seal for a corresponding direction of rotation. The inactive sealing segment 43.1, 43.2 is held in position by means of a spring element 52.1, 52.2. The seal between the radial sealing segments 42; 43.1, 43.2, also between the pinion segment 42 and the respective hollow gear segment 43.1, 43.2, is ensured by means of sealing rollers 49.1, 49.2 arranged at both sides. The sealing rollers 49.1, 49.2 are made from a high-strength temperature-resistant plastic. The sealing rollers 49.1, 49.2 are accommodated in suitable recesses 48.1, 48.2 of the pinion segment 42. The sealing rollers 49.1, 49.2 are pressed under pressurizing medium pressure against a sealing surface of the pinion segment 42 and against a sealing surface of the respective active hollow gear segment 43.1, 43.2 during operation of the internal gear machine 21. The sealing rollers 49.1, 49.2 are pressed against the sealing surfaces by means of the respective sealing roller spring 50.1, 50.2 in the non-pressurized state. The sealing surfaces are arranged at a special angle 66, which is smaller than 110°. The contact pressure of the sealing rollers 49.1, 49.2 also achieves a "spreading" of the radial sealing segments 42; 43.1, 43.2 and thus an abutment of the radial sealing segments 42; 43.1, 43.2 against the tooth heads of the teeth 28, 31 of the pinion 26 and the hollow gear 30.

The hydraulic actuation is carried out via the radial gap 75.1, 75.2 between the outer peripheral surface 43 of the pinion segment 42, also called the inner surface, and the respective inner peripheral surface 44.1, 44.2 of the respective hollow gear segment 43.1, 43.2, also called the inner surface. At least one additional control groove 63.3.1, 63.3.2 is mounted in at least one axial sealing plate, preferably in the axial sealing plates 58.1, 58.2, for a secure actuation. The pressurizing medium or pilot oil can arrive not just via the radial gap 75.1, 75.2 between the radial sealing segments 42; 43.1, 43.2 in the corresponding space, but also via the faces or on the face side in the gap between the segments 42; 43.1, 43.2 through this at least one additional control groove 63.3.1, 63.3.2. This "dual" actuation has proven to be extremely effective in preventing a drop in conveyance, especially under the dynamic demands of reverse operation of the internal gear machine 21. In other words: The necessary radial compensatory pressure in the gap 75.1, 75.2 between the segments 42; 43.1, 43.2, and therefore optimal radial sealing, is hereby achieved almost "simultaneously" with reversal in the direction of rotation.

Other optimizations are possible by means of chamfers 65.1, 65.2, 65.5, 65.6 and/or grooves 65.3, 65.4 on the pinion segment 42 and/or on the hollow gear segments 43.1, 43.2. The chamfers 65.1, 65.2, 65.5, 65.6 can be advantageously installed on both sides, but also on one side of the segments 42; 43.1, 43.2. Through these chamfers 65.1, 65.2, 65.5, 65.6, the pressurizing medium or pressure oil building up in the pressure chamber can arrive faster in the space, that is, in the gap or compensation chamber formed by means of the radial gap 75.1, 75.2 between the pinion 26 and the active hollow gear segment 43.1, 43.2 up to the respective sealing roller 49.1, 49.2. These chamfers 65.1, 65.2 can be arranged, as described, between the segment spring groove 51.1 and the sealing roller groove 48.1 and/or from the segment spring groove 51.1 up to the stop pocket or up to the stop 54.1 at the segment carrier 42 and/or over the entire stop surface 55.1 up to the free surface 67.1. Pressurizing medium or pressure oil can then directly or indirectly flow into the gap or compensation chamber 75.1, 75.2 via these chamfers 65.1, 65.2. As described, these chamfers 65.5, 65.6 can alternatively or additionally also be installed on the hollow gear segments 43.1, 43.2. The same tasks can also be assumed by control grooves 65.3, 65.4 at the outer periphery of the pinion segment 42 and/or the inner periphery of the hollow gear segments.

The filler element 41 is supported by two retaining pins or bolts 45.1, 45.2, which are rotatably mounted via corresponding bores 68.1, 68.2 in the housing parts 25.1, 25.2 in the shown exemplary embodiment. The retaining pins or bolts 45.1, 45.2 have a perfectly cylindrical guiding area 69.1, 69.2 that spans an outer diameter over a guiding length. The guiding length preferably amounts to 1.5× outer diameter of the guiding area 69.1, 69.2. For cost reasons, the retaining pins or bolts 45.1, 45.2 are produced from sintered material, preferably from sintered iron, with the corresponding strength. The inner diameter of the bores 68.1, 68.2 of the housing parts 25.1, 25.2 is greater by a few micrometers than the outer diameter of the guiding area 69.1, 69.2 of the retaining pins or bolts 45.1, 45.2. Play adaptation is obtained in this way. The retaining pins or bolts 45.1, 45.2 can thus rotate during operation of the internal gear machine 21 and the abutment faces 71.1, 71.2, which preferably enclose an angle 70 of 24°, can rotate in a position that is optimal for the sealing function of the segments 42; 43.1, 43.2. Because the guiding length amounts to 1.5× outer diameter, the surface pressure is reduced, on the one hand, while on the other hand impermissible tilting of the respective retaining pin or bolt 45.1, 45.2 in the receiving bore 68.1, 68.2 of the respective housing part 25.1, 25.2 is prevented. A wear protection coating on the outer diameter of the respective retaining pin or bolt 45.1, 45.2 increases the service life of the gear machine 21, in particular during highly dynamic load and change of direction of rotation, as well as during dynamic switchover between motor and pump operation. For cost reasons, this wear protection is attained by means of surface hardening, such as nitration or carbonitration with the corresponding material selection.

The respective retaining pin or bolt 45.1, 45.2 has a perfectly cylindrical step 76.1, 76.2 on its side that faces away from the abutment faces 71.1, 71.2 that are arranged in V shape. The step 76.1, 76.2 has a markedly smaller outer diameter in comparison with the guiding area 69.1, 69.2. The face 77.1, 77.2 of the step 76.1, 76.2 is applied on the bore base of the bore in the housing part 25.1, 25.2 and forms in this way an axial stop of the retaining pins or bolts 45.1, 45.2 in the direction of the affected housing part 25.1, 25.2. In the direction of the radial sealing segments 42; 43.1, 43.2, the axial shiftability of the retaining pin or bolt 45.1, 45.2 is limited by means of a face 78.1, 78.2 between the abutment faces 71.1, 71.2 and the groove base 79.1, 79.2 of the segment grooves 80.1, 80.2 of the pinion segment 42. The retaining pin or bolt 45.1, 45.2 must basically have axial play, but also or nevertheless should not collide with the teeth 28, 31 of the pinion 26 or the hollow gear 30. Free surfaces are also installed for this purpose. Said step 76.1, 76.2 allows cost-effective production of the bores 68.1, 68.2 in the housing parts 25.1, 25.2, for example, by using a reamer with a relatively large cutting chamfer. This means that the bore 68.1, 68.2 does not have to have the fit diameter up to the bore base. The largest possible radii 81 are fitted at the transition of the abutment faces 71.1, 71.2 to the fit diameter in order to increase the durability of the retaining pin or bolt 45.1, 45.2 and therefore the security and service life of the hydraulic machine 21. Chamfers 82 on the segment side face 77.1, 77.2 of the respective retaining pin or bolt 45.1, 45.2 also allow radii 83 of the grooves 80.1, 80.2 of the pinion segment 42 intended for support on the retaining pin or bolt 45.1, 45.2 on the groove base 79.1, 79.2. These radii 81, 83 reduce the notch stress at the segments 42; 43.1, 43.2, which are preferably made from special brass or sintered material, without limiting the mobility of the segments 42; 43.1, 43.2 as a result of jamming.

The pressure buildup in the teeth gaps 29, 32 of the pinion 26 and hollow gear 30 is controlled by means of control grooves 63.1.1, 63.1.2; 63.2.1, 62.2.2 and control slots 64.1.1, 64.1.2; 64.2.1, 64.2.2 introduced through the respective axial washer 58.1, 58.2. These are optimized in their position as well as the cross sectional areas in particular of the control slots 64.1.1, 64.1.2; 64.2.1, 64.2.2 with a triangular V-shaped cross section preferably with a V-angle of 60° and an angle of inclination preferably within the range of 4°, so that a radial compensating effect of the pinion segment 42 and the respective active hollow gear segment 43.1, 43.2, which is nearly optimal at all operating points, is obtained in interaction with the location and position of the segments 42; 43.1, 43.2, in particular the sealing roller position and the angle 70 of the abutment faces and support surfaces 71.1, 71.2; 73.1, 73.2 of the retaining pin 45.1, 45.2 or the pinion segment grooves 80.1, 80.2 as well as the location and position in particular of the two lateral faces 84.1, 84.2 of the V-shaped free surface 85 in the axial washers 58.1, 58.2. The control grooves 63.1.1, 63.1.2; 63.2.1, 62.2.2 have a direct connection to the respective pressure pocket 62.1, 62.2 of the respective axial sealing washer 58.1, 58.2 and are thus directly pressurized with pressurizing medium or pressure oil during the operation of the internal gear machine 21. Control slots 64.1.1, 64.1.2; 64.2.1, 64.2.2, control grooves 63.1.1, 63.1.2; 63.2.1, 62.2.2; 63.3.1, 63.3.2 and pressure pockets 62.1, 62.2 are arranged at both sides of the gearing mechanism. Unilateral approaches in which the cross sections are accordingly adapted are also conceivable, however.

Retention of the segments 42; 43.1, 43.2 is achieved by means of the engagement of the respective retaining pins 45.1, 45.2 in the corresponding grooves 80.1, 80.2 in the pinion segment 42 and by means of a radial transfer of the retaining pin 45.1, 45.2 radially outward beyond the pinion segment 42. The position of the segments 42; 43.1, 43.2 is thus also form lockingly provided in the non-pressurized state. The grooves 80.1, 80.2 of the pinion segment 42 must be slightly larger or wider than the part 86.1, 86.2 of the respective retaining pin 45.1, 45.2, which is also called a retaining element and projects into the grooves 80.1, 80.2, in order to ensure the mobility or the shiftability with the segments 42; 43.1, 43.2 in the previously described advantageous V-shaped embodiment of the abutment faces 71.1, 71.2 of the retaining pin or bolt 45.1, 45.2. The play must be selected according to the gear mechanism tolerances of the housing parts 25.1, 25.2, segments 42; 43.1, 43.2, bearing bushings as well as the deformation under load, and taking into consideration the thermal expansion of the components within the temperature range of the application: A play of between 0.05 and 0.1× module of the gear tooth system of the displacement device has proven to be advantageous. In this way also, jamming of the gear tooth system as a result of the wedge-shaped segments 42; 43.1, 43.2 is also prevented in non-pressurized operation.

Axial Compensation:

The preferably bilateral axial compensation can be achieved by means of inherent pressure, just like the radial compensation. Axial compensation is achieved via axial plates 58.1, 58.2 controlled by axial pressure fields 61.1, 61.2, which are symmetrical to a symmetry plane containing the rotational axes of the pinion 26 and the hollow gear 30. This symmetry plane 87 runs through the center point 88 of the rotational axis 34.2 of the pinion 26 and the center point 89 of the rotational axis 36 of the hollow gear 30 in a cross section that is perpendicular to the axial direction 39 or the rotational axes 34.2, 36 when observed from the cross section running from the pinion 26 and hollow gear 30. This symmetry applies for the respective axial washer 58.1, 58.2 as well as for the axial pressure spring 61.1, 61.2 installed in the preferably pot-shaped housing part 25.2 and/or in the housing part 25.1, which is preferably configured as a cover.

Sealing of the axial pressure fields 61.1, 61.2 preferably is by means of axial seals 90 with support rings 91 (refer to FIGS. 8 to 10). The axial seal would have to be completely "chambered" in axial seals without supporting rings with this highly dynamic reversibly used hydraulic machine. This means that the groove would have to additionally have a "rim" facing "inwardly" toward the pressure field in order to accommodate the seal. This necessary "rim" would hamper the production of the housing or cover parts. The pressure field 61.1, 61.2 can be entirely produced in pocket shape with the supporting ring 91. The base of the pressure fields 61.1, 61.2 need not be completely mechanically processed, but can be produced, for example, with pressure die cast parts or other die cast parts by means of the casting process.

The supporting ring 91 has in addition the advantage that it prevents a gap extrusion of the axial seal 90 into the gap between the axial plate 58.1, 58.2 and the housing or top wall. The hydraulic machine 21 can hereby also be used for higher pressures. A gap extrusion of the axial seal occurring without supporting ring would furthermore cause a minor enlargement of the active axial pressure field and would as a result increase the compensation force. This would in turn lead to a reduction of the hydraulic-mechanical efficiency and would therefore worsen the energy efficiency of the motor pump unit. In the worst case, a malfunction of the hydraulic machine could occur as a result of a seal failure or increased wear of the running surfaces of the axial washer on the side of the gear mechanism.

The "inward" supporting effect of the supporting rings 91 is considerably improved by means of one or several bridges 92. The arrangement of these bridges 92 must be selected in such a way that the oil flow particularly to the axial pressure output or also the oil flow from the inlet is not affected. The bridge 92 is located precisely in the same position as a bridge 93.1, 93.2 that is arranged in the pressure pocket 62.1, 62.2 of the respective axial washer 58.1, 58.2 in the shown example. The axial compensation is optimally adjusted in the described example by means of the provisions described below. The pressure pockets 62.1, 62.2 arranged symmetrically to the symmetry plane 87, whose boundary radii project, on the one hand, over the tooth base radius of the pinion gear tooth system and, on the other hand, over the tooth base radius of the hollow gear tooth system, ensure a constant counteracting force. In this way, the onset of changing compensation forces as a consequence of changing pressures between the faces 56.1, 56.2; 57.1, 57.2 of the teeth 28, 31 and the axial washer 58.1, 58.2, which would result in the axial plate without these pressure pockets, is prevented in this area. An exact adaptation of the axial compensation is achieved by means of a calculated and empirical determination and specification of the discharge diameter of the pinion 26 and hollow gear 30. The or each axial washer 58.1, 58.2 preferably has two breakthroughs 94.1, 95.1; 94.2, 95.2. The pressurizing medium flows through these breakthroughs 94.1, 95.1; 94.2, 95.2 from the input side to the pressure pocket 62.1, 62.2 and inversely from the pressure pocket 62.1, 62.2 over the pressure fields 61.1, 61.2 to the pressure output. Each bridge 93.1, 93.2 is located in the exemplary embodiment at approximately the height of the pinion center and has a cross section dimensioned in such a way that approximately 50% of the hydraulic force produced by the operating pressure in the pressure pocket 62.1, 62.2 and the breakthroughs 94.1, 95.1; 94.2, 95.2 is absorbed. Transition radii at the breakthroughs reduce the notch stress and consequently increase the permissible operating pressures or increase the service life of the hydraulic machine 21. The or each axial washer 58.1, 58.2 is usually produced from brass or aluminum, but can also be produced by means of a sintering process or by means of metal powder injection molding (MIM technology). An accordingly minimized friction coating is advantageously applied to reduce friction.

Figure 2:
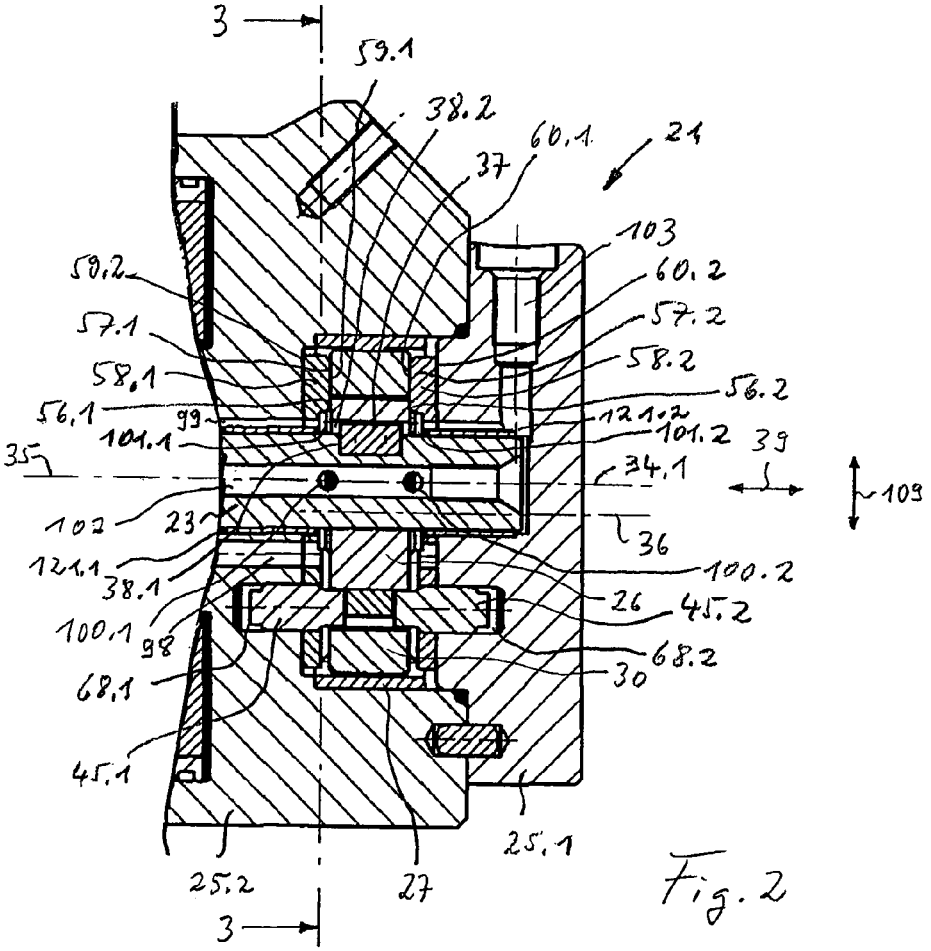
FIG. 2 shows a longitudinal section of a section of the motor pump unit in the area of the internal gear machine within a section plane that contains the pinion rotational axis of the pinion and the hollow gear rotational axis of the hollow gear.
Figure 11:
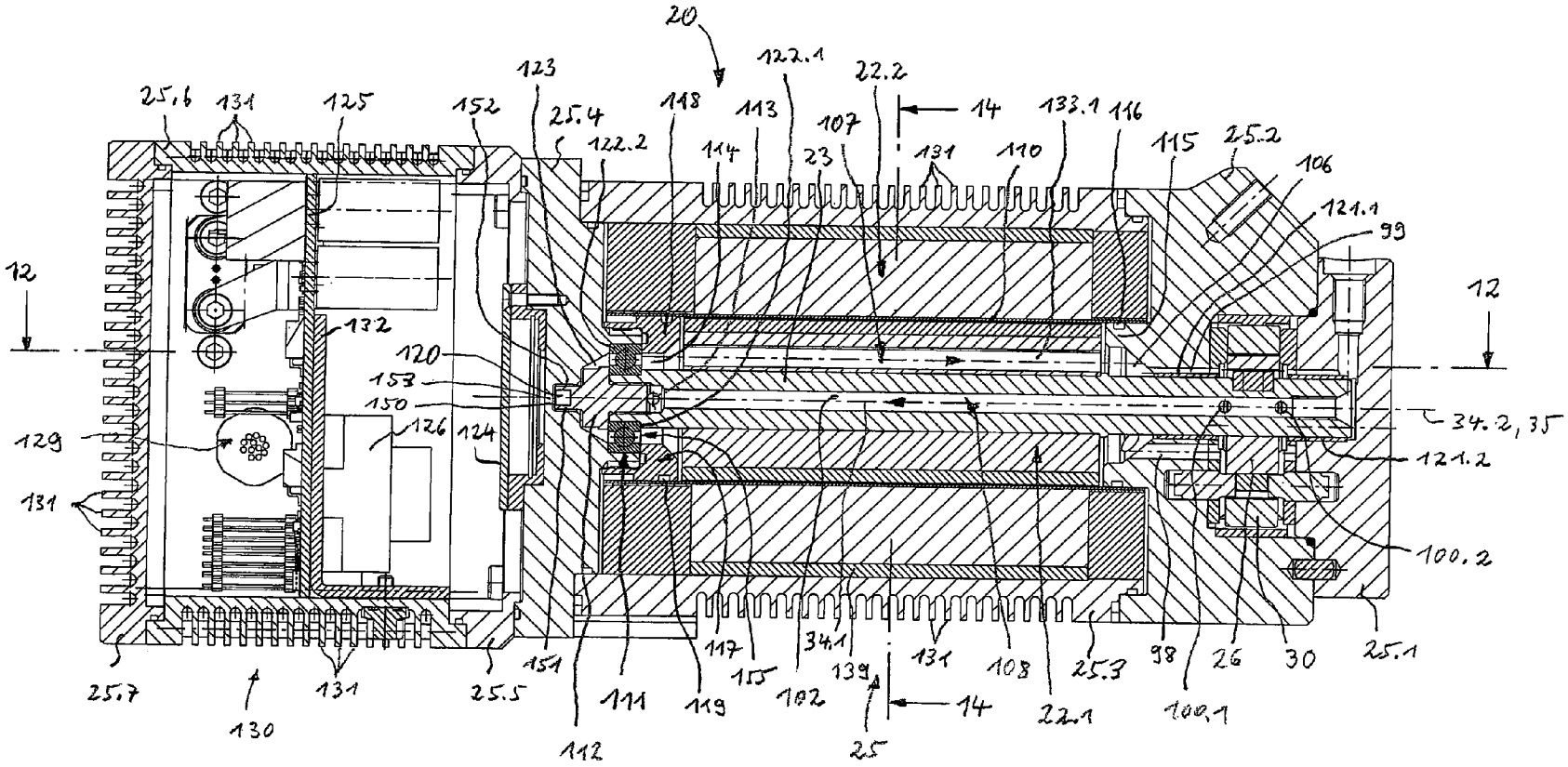
FIG. 11 shows a longitudinal section of the motor pump unit in a section plane that contains the pinion rotational axis of the pinion and the hollow gear rotational axis of the hollow gear.

As described above, the radial expansion of the pressures is achieved by means of the control grooves 63.1.1, 63.1.2; 63.2.1, 63.2.2; 63.3.1, 63.3.2 and the control slots 64.1.1, 64.1.2; 64.2.1, 64.2.2 as well as by means of the V-shaped free surface 85 and at the tooth engagement 33 by means of sealing along the engagement line. Fixation of the respective axial plate 58.1, 58.2 takes place, on the one hand, by means of projection of the bearing bushings that support the shaft 23 on the inner diameter as well as retaining pins or bolts 45.1, 45.2 on the through bore on the outer periphery of the respective retaining pin or bolt 45.1, 45.2. The respective axial plate 58.1, 58.2 is freely movable within the provided axial play in the axial direction 39. The leakage oil originating over the axial washer or plate 58.1, 58.2 as well as the leakage oil originating over the sealing roller 49.1 49.2 collects in the area of the V-shaped free surface 85 as well as in the annular space, which is formed by means of the chamfer 96 of the respective axial sealing washer 58.1, 58.2 on the hollow gear 30 and in the annular space 101.1, 101.2 also called the leakage channel, which is formed with the chamfer 97 of the respective axial sealing washer 58.1, 58.2 on the pinion 26. This leakage oil is guided in part via a bore 98 as well as a groove 99 in the connecting space 106. A large or basic part of the total leakage oil flows via radial bores 100.1, 100.2 into the shaft (pump motor shaft) 23 arranged in the area of the respective annular space 101.1, 101.2, and a central, axially installed discharge bore 102 of the shaft 23, also called the leakage shaft channel (refer to FIGS. 2, 11 and 12). It is understood that the bore 98 and/or the groove 99 can also be omitted. In this last-mentioned case, the total leakage oil would flow via the radial bores 100.1, 100.2 of the shaft 23 into the leakage shaft channel 102. The flow speed or discharge of leakage oil in the can chamber 107 or the leakage channel loop 108 could be maximized as a result. "Can chamber" 107 is the name given to the space located in the interior or inside the sealing tube or can 110 observed in the radial direction 109, which is radially outwardly delimited by the sealing tube or can 110. An even better heat dissipation could be achieved by means of the aforementioned provisions. An even better lubrication of the motor mount 111 could be achieved at the same time. An overall even longer service life or malfunction-free operation of the motor pump unit 20 could be achieved thereby. A venting screw 103 for filling and venting the complete hydraulic system is installed in the pump cover 25.1. The discharge bore 102 is sealed by means of a bearing mounting screw 112, also called a sealing means, in the area of the radial ball bearing 111 arranged in the motor flange 25.4 and ends in a radially installed bore 113. This radial bore 113 ends in an annular space 114, which is also called a connecting space.

Overall Design of the Motor Pump Unit:

The requirement of absolute tightness can only be achieved by means of a hermetically sealed system. There are three possibilities to attain this:

1. Magnetic coupling between pump and motor
2. Canned motor—motor submerged in oil
3. Complete motor under oil with pressure resistant current feedthrough The magnetic clutch is eliminated for space and cost reasons. A special motor 22 with a "can" 110 also called a sealing tube, was developed for the preferred application of the motor pump unit 20. The designation "can" stems from the fact that this tube 110 is arranged between the rotor 22.1 and the stator 22.2. The sealing tube or can 110 is made from non-magnetic material, preferably high temperature-resistant, pressure-resistant, fiber-reinforced plastic. The sealing tube 110 extends almost over the full length of the stator package and is encapsulated in plastic with the stator 22.2, including the coil and the motor housing 25.3, forming a unit. The cover or housing part 25.2 projects with a corresponding centering collar 115 with O-ring groove 116 into the sealing tube or can 110 on the side of the sealing tube or can 110 that faces toward the pinion. A bearing mounting screw 117 with a corresponding centering collar 118 with O-ring groove 119 projects into the sealing tube or can 110 on the side of the sealing tube or can 110 that faces away from the pinion. O-rings accommodated in the O-ring grooves 116, 119, not shown in the drawings, assume the sealing function, and thus seal the canned motor chamber 107 at least against leakage fluid on both sides of the rotor 22.1.

The common motor pump shaft 23 bears the pressed-on rotor 22.1 and contains comprises pressure compensation bores and the bearing mounting or sensor screw 107 for receiving a speed sensor 120. The motor pump unit 23 is mounted only on or in the radial ball bearing 111 on the motor side and on or in at least one slide bearing, preferably on or in two slide bearings 121.1, 121.2 on the pump side. The pinion 26 of the pump or hydraulic machine 21 is mounted by means of a clearance fit on the pump motor shaft 23 and rotatably entrained by means of the slightly crowned feather key 37. The inner ring 122.1 of the ball bearing 111 is screwed with the bearing mounting screw 117 to the bearing cover or housing part 25.4 on the side of the electronics. The motor pump unit 23, and thus also the pressed-on rotor 22.1, are axially fixed in this way. The bearing cover 25.4 has an especially stepped blind hole 123, into which the bearing mounting and sensor screw 112 projects. The signal transmission takes place through the closed bearing cover or housing part 25.4, which has a wall thickness of a few millimeters in the area of the sensor 120. The wall thickness preferably amounts to about 2 mm. The electronics circuit board 124 of the speed sensor 120 is arranged on the side of the bearing cover or housing part 25.4 that faces away from the motor 22 in a housing part shaped as a flange mount 25.5 and a circuit board 125 of the motor controller, here the final stage 126, also at a specific axial distance thereto. A control circuit board is arranged on this final stage 125. The phasing lines 127 (refer to FIG. 1)

of the motor 22 preferably lead through bores in the housing part or bearing cover 25.4 and are screwed or plugged into or soldered to the final stage 126. Sensor lines of temperature sensors that measure the coil temperatures of the motor 22 are similarly arranged. The motor pump unit 20 is connected via a power plug 128 as well as a signal plug 129 with small dimensions. The two plugs 128, 129 are sealingly installed on the electronics box 130. The electronics box 130 is formed by a tubular housing part 25.6 and a housing part 25.7 configured as a cover as well as the housing part 25.4 likewise called a bearing cover or motor flange. The electronics box 130 with cooling ribs 131 is likewise screwed on. Sealing elements are likewise arranged between the individual elements of the electronics box 130. The final stage 126 is assembled with heat conductive paste on a mounting angle 132 preferably made from copper. The heat development of the components is guided hereby through the copper angle 132 into the cooling ribs 131 of the tubular housing part 25.6 of the electronics box 130. The cover 25.6 of the electronics box 130 and the tubular motor housing 25.3 are likewise provided with cooling ribs 131. The intermediate housing of the hydraulic machine at the same time also constitutes the bearing cover 25.4 or the motor flange of the electric motor 22. The hydraulic machine is configured as a compensated 4-quadrant internal gear machine 21 and is basically fluidically connected to the interior of the sealing tube or can 110.

Figures 12, 13:
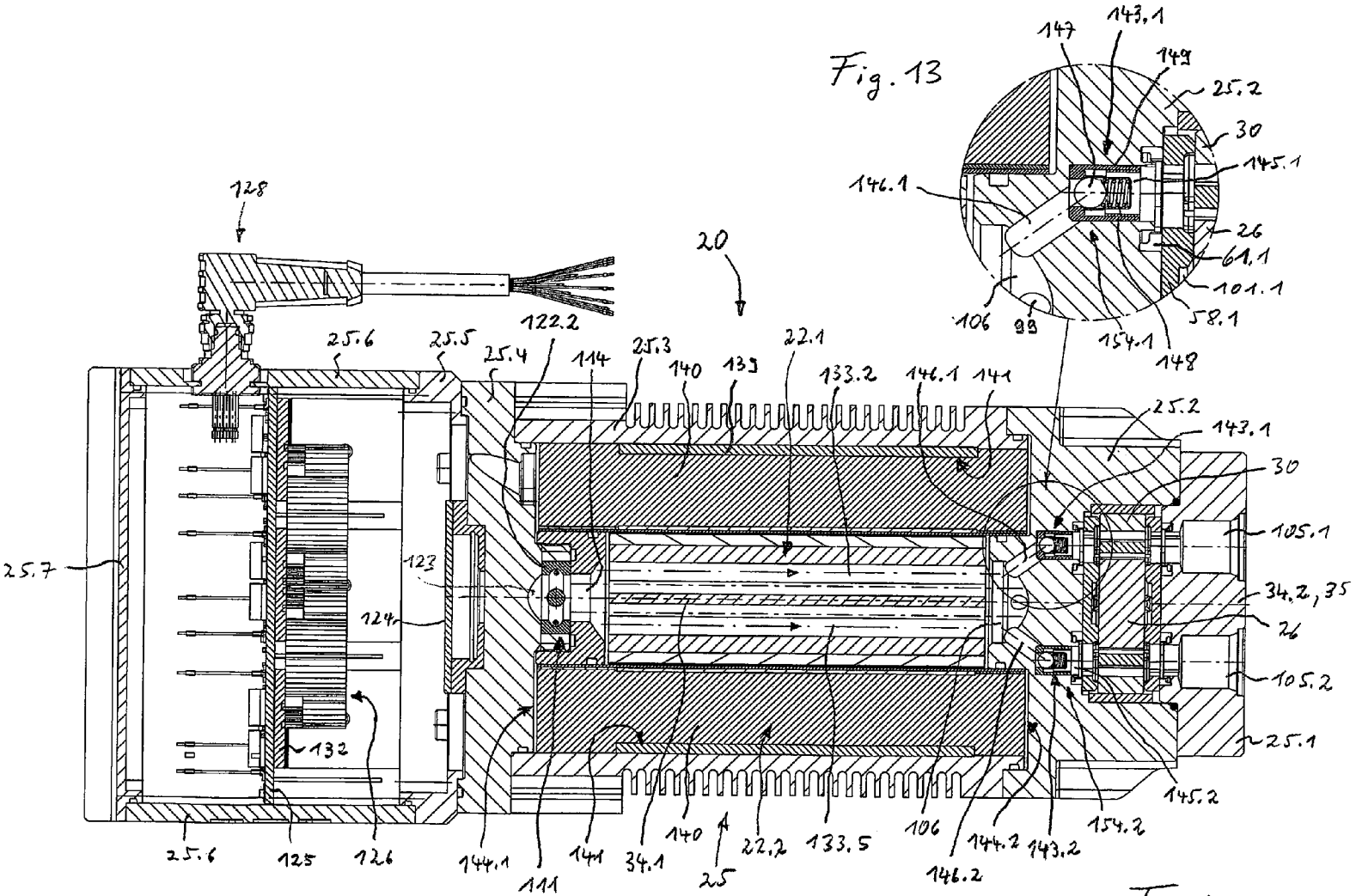
FIG. 12 shows a longitudinal section of the motor pump unit within a section plane according to section lines 12-12 in FIG. 11.
FIG. 13 shows a greatly enlarged cutout according to the circle marked in FIG. 12.
Figure 15:
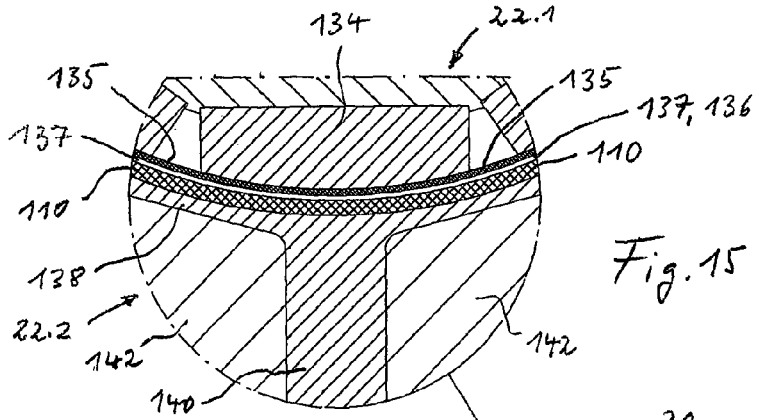
FIG. 15 shows a greatly enlarged cutout according to the partial circle marked in FIG. 14.
Figure 14:
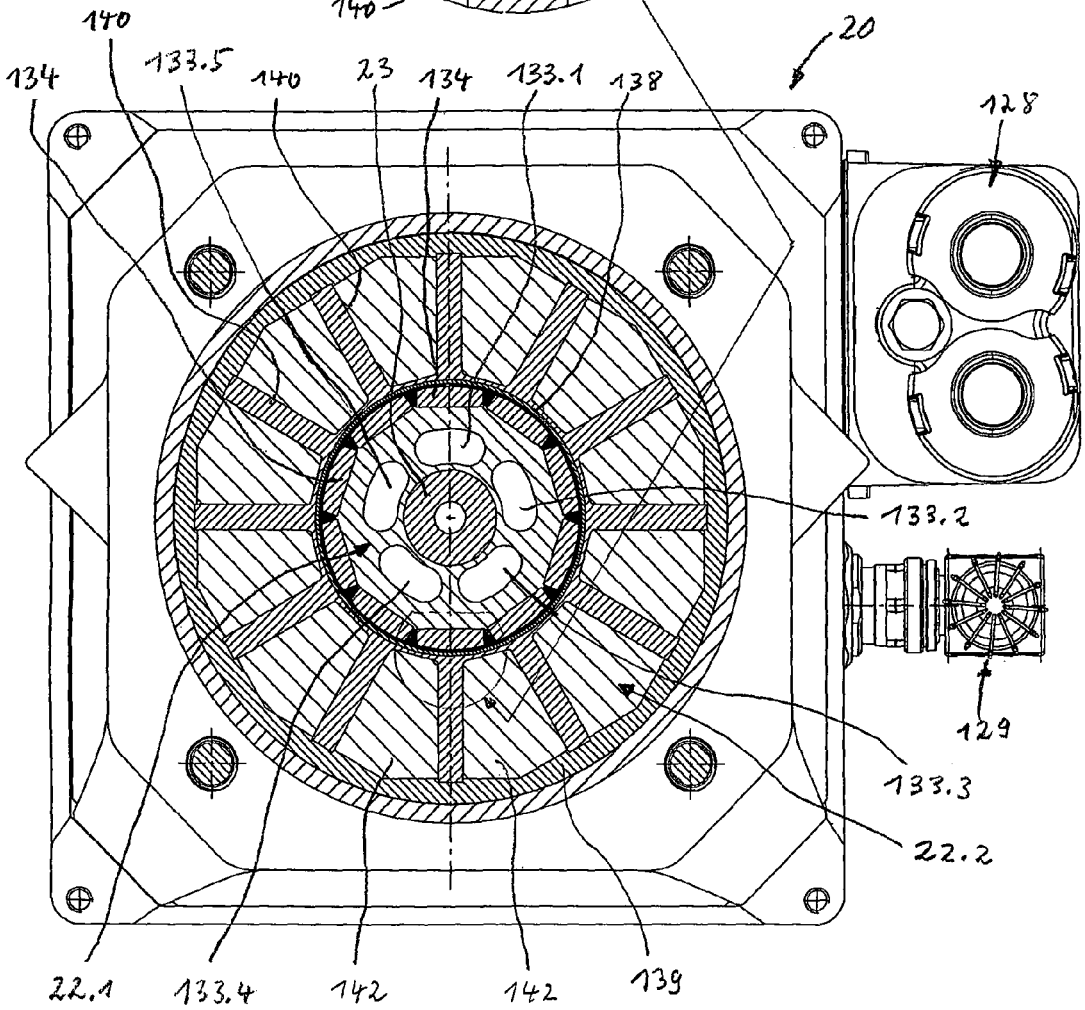
FIG. 14 shows a cross section of the motor pump unit within a section plane according to section lines 14-14 in FIG. 11.

An electric motor 22 in the form of a brushless direct current motor (EC motor) has proven to be particularly advantageous especially for the application or use of the motor pump unit 20 for actuation or operation of a highly dynamic hydraulic axis. As can be seen in FIGS. 12 and 14, the rotor 22.1 of the electric motor 22 comprises a multitude of recesses 133.1, 133.2, 133.3, 133.4, 133.5, also called leakage rotor channels. These are preferably arranged mutually offset by identical peripheral angles around the rotor rotational axis 33.1 or the shaft rotational axis 35. Five leakage rotor channels 133.1, 133.2, 133.3, 133.4, 133.5 are provided in the shown exemplary embodiment. The rotor 22.1 also comprises a multitude of high-performance magnets 134, preferably permanent magnets. The magnets 134 are arranged mutually offset by identical peripheral angles around the rotor rotational axis 34.1 or the shaft rotational axis 35. Ten magnets 134 are provided in the shown exemplary embodiment. As can be especially seen in FIG. 15, the magnets 134 are provided with a tubular bandage 135 on their outer surfaces that face radially outwardly away from the rotor rotational axis 34.1 or the shaft rotational axis 35. This bandage 135 delimits the rotor 22.1 radially outwardly at its outer periphery. The rotor 22.1 is rotatably mounted with respect to the stator 22.2 in a cylindrical mounting space 136 of said stator. The can 110, which is also called sealing tube and is fixedly connected to the stator 22.2, is likewise arranged in the cylindrical mounting space 136 of the stator 22.2, but when observed in the radial direction 109 between the rotor 22.1 and the stator 22.2. A narrow annular gap 137, which is also called a leakage gap channel 137, is configured between the sealing tube or can 110 and the rotor 22.1 when observed in the radial direction 109. This annular channel 137 extends in the axial direction 39, preferably substantially over or over the total axial length of the rotor 22.1.

The stator 22.2 comprises an inner tube 138 and an outer tube 139 as well as several bridges 140 that extend in the radial direction 109 between the inner tube 138 and the outer tube 139 and also in the axial direction 39, which are connected at one end to the inner tube 138 and at the other end to the outer tube 139. Twelve bridges 140 are preferably provided in the shown exemplary embodiment (refer to FIG. 14). As can be seen in FIG. 12, the bridges 140 have a recess 141 at their radial outer ends, in which the outer tube 139 of the stator 22.2 is arranged. The respective recess 141 has an axial width or the outer tube 139 has an axial length that is slightly smaller than the axial length of the rotor 22.1 when observed in the axial direction 39. The stator 22.2 is produced from several stator sheets. A mounting space 142 is respectively configured between neighboring bridges 140 of the bridges 140, the inner tube 138 and the outer tube 139 of the stator 22.2. Twelve mounting spaces 142 that correspond to the number of bridges 140 are thus preferably provided in the shown exemplary embodiment. Each mounting space 140 serves to accommodate stator coils of metal wires, which configure the phasing lines 127. Each mounting space 142 furthermore serves to accommodate grouting material. The stator 22.2 is accommodated in a cylindrical stator mounting space of the motor housing 25.3 of the housing 25 of the motor pump unit 20 and is fixedly connected to the motor housing 25.3.

At least one leakage channel 101.1, 101.2, which is fluidically connected to the working chamber 24 and preferably configured as an annular space, and via which the leakage oil that forms under pressure along the axial and radial sealing surfaces during operation of the internal gear pump 21 is discharged, is arranged in the housing part 25.2 of the housing parts 25.1, 25.2 of the housing 25 that delimit the working chamber 24 of the pump 21. In other words, the at least one leakage channel 101.1, 101.2 serves for the discharge of the leakage fluid consisting of fluid pressurizing medium that forms during operation of the internal gear machine 21 in particular with a radial and/or axial gap seal by means of the radial sealing segments 43.1, 43.2 and/or the at least one axial sealing plate 58.1, 58.2. The annular space 101.1, 101.2, which is configured in each axial sealing plate 58.1, 58.2 and which is open to the working chamber 24 in the axial direction 39 and to the shaft 23 in the radial direction 109, functions in particular as a leakage channel (refer to FIGS. 2, 4 and 11).

The shaft 23 extends with one shaft end 23.1 of its two shaft ends 23.1, 23.2 away from the pinion 26 in the axial direction 39 through the rotor 22.1 supported by the shaft 23. The connecting channels 105.1 arranged in the housing part 25.1 of the housing 25 are connected via check valves 143.1, 143.2 arranged in the housing 25 or in the housing part 25.2 of the housing 25 that delimits the working chamber 24 of the internal gear machine 21 to the leakage channel loop 108 that is fluidically connected to the at least one leakage channel 101.1, 101.2. The leakage channel loop 108 extends over the rotor end 144.1 of the rotor 22.1 that extends away from the pinion 26. The leakage channel loop 108 has the leakage shaft channel 102 that extends in the axial direction 39 in the shaft 23 or through the shaft 23, and is also called a discharge bore, and at least one leakage rotor channel 133.1, 133.2, 133.3, 133.4, 133.5 of the rotor 22.1 that is fluidically connected to leakage shaft channel 102, which extends at a radial distance from the leakage shaft channel 102 and through the rotor 22.1 in the axial direction 39, and the leakage gap channel 137 that is likewise fluidically connected to the leakage shaft channel 102 and is configured between the rotor 22.1 and the stator 22.2 and extends in the axial direction 39 when observed in the radial direction 109. The check valves 143.1, 143.2 open in a fluid flow direction from the leakage channel loop 108 to the respective active low pressure area of the working chamber 24 and lock in the opposite direction or in the opposite fluid flow direction from the respective active high pressure area of the working chamber 24 to the leakage channel loop 108. Thus during operation of the internal gear pump 21, this ensures that the leakage fluid flows from the at least one leakage channel 101.1, 101.2 through the leakage channel loop 108 into the working chamber 24. The leakage fluid, that is, with the exception of a leakage flow portion that is minor in comparison with the total leakage flow, basically flows from there into the connecting channel 105.1, 105.2 allocated to the respective active low pressure area.

In other words, it can be provided according to the invention that the leakage shaft channel 102 that extends in the axial direction 39 is arranged in the shaft 23, which is fluidically connected to the at last one leakage channel 101.1, 101.2, and that at least one leakage rotor channel 133.1, 133.2, 133.3, 133.4, 133.5 that extends in the axial direction 39 through the rotor 22.1, preferably at a radial distance, in particular parallel to the leakage shaft channel 102, is arranged in the rotor 22.1, and is fluidically connected to the leakage shaft channel 102 and/or that a leakage gap channel 137 that extends in the axial direction 39 when observed in the radial direction 109 and configured between the rotor 22.1 and the stator 22.2 is fluidically connected to the leakage shaft channel 102, and that the leakage shaft channel 102 or the leakage rotor channel 133.1, 133.2, 133.3, 133.4, 133.5 and/or the leakage gap channel 137 is connected via a first check valve 143.1 arranged in the housing 25 or in a housing part 25.2 of the housing 25 that delimits the working chamber 25 to the first connecting channel 105.1 and via a second check valve 143.2 arranged in the housing 25 or in one or the housing part 25.2 that delimits the working chamber 24 to the second connecting channel 105.2, and that the first check valve 143.1 prevents the fluid flow of fluid pressurizing medium from the then active first high pressure area 44.1 of the working chamber 24 via the first check valve 143.1 in the leakage shaft channel 102 or in the leakage rotor channel 133.1, 133.2, 133.3, 133.4, 133.5 and/or in the leakage gap channel 137 with rotation in the first operating direction 104.1, and the second check valve 143.2 allows a fluid flow of the leakage fluid either from the leakage shaft channel 102 or from the leakage rotor channel 133.1, 133.2, 133.3, 133.4, 133.5 and/or from the leakage gap channel 137 via the second check valve 143.2 into the then active first low pressure area 44.1 of the working chamber 24, and that the second check valve 143.2 prevents a fluid flow of fluid pressurizing medium from the then active second high pressure area 44.2 of the working chamber 24 via the second check valve 143.2 in the leakage shaft channel 102 or in the leakage rotor channel 133.1, 133.2, 133.3, 133.4, 133.5 and/or in the leakage gap channel 137 during a rotation in the second operating direction 104.2, and the first check valve 143.1 allows a fluid flow of leakage fluid either from the leakage shaft channel 102 or from the leakage rotor channel 133.1, 133.2, 133.3, 133.4, 133.5 and/or from the leakage gap channel 137 via the first check valve 143.1 into the then active second low pressure area 44.2 of the working chamber 24, so that the leakage fluid, preferably in a leakage fluid circuit, flows from the at least one leakage channel 101.1, 101.2 either through the leakage shaft channel 102 and from there through the leakage rotor channel 133.1, 133.2, 133.3, 133.4, 133.5 and/or through the leakage gap channel 137, or inversely, via the second check valve 143.2 into the then active first low pressure area 44.1 of the working chamber 24 during rotation in the first operating direction 104.1, and the leakage fluid, preferably in a leakage fluid circuit, flows from the at least one leakage channel 101.1, 101.2 either through the leakage shaft channel 102 and from there through the leakage rotor channel 133.1, 133.2, 133.3, 133.4, 133.5 and/or through the leakage gap channel 137, or inversely, via the first check valve 143.1 into the then active second low pressure area 44.2 of the working chamber 24 during the rotation in the second operating direction 104.2.

Shuttle Valves/Check Valves:

FIG. 12 shows a longitudinal section through the gear machine 21 in the area of two arranged check valves 143.1, 143.2. The check valves 143.1, 143.2, which are also called shuttle valves, have the task of always connecting the can chamber 107 to the working connections or connecting channels 105.1 and 105.2 in such a way that a pressure that is as low as possible is present in the can chamber 107. The described motor pump unit 20 is preferably used in a closed hydraulic system that is not shown in the figures. This hydraulic system can also comprise, for example, in addition to a double or single acting hydraulic cylinder, a pressure accumulator preferably configured as a membrane pressure accumulator, which is capable of compensating or compensates for volume changes due to different piston areas as well as temperature fluctuations. The pressure accumulator ensures a specific system or preload pressure. The system or preload pressure is preferably within the range of 5 to 40 bar. The working pressure of the internal gear machine 21 is superimposed on this preload or system pressure. The working pressure can amount to up to 120 bar or even up to 250 bar or more. The shuttle valves 143.1, 143.2 now have the task of ensuring that only the lowest pressure is always present in the area of the can chamber 107. The shuttle valves 143.1, 143.2 are respectively located in an axial bore 145.1, 145.2 (refer to FIGS. 12 and 13), also called a channel part of a reverse flow channel 154.1, 154.2, preferably configured as a blind bore, located in the respective pressure field 61.1, 61.2, here for example the housing part 25.2 (refer to FIGS. 7 and 13). An oblique bore 146.1, 146.2 of the respective reverse flow channel 154.1, 154.2 connects the bore base of the respective axial bore 145.1, 145.2 to the can chamber 107 via the connecting space 106 (refer to FIGS. 12 and 13). The shuttle valves 143.1, 143.2 are conventional spring-loaded check valves with a ball 147 as sealing and locking element and a spring 148, by means of which the ball 147 is prestressed in its sealing and locking position. The ball 147 and the spring 148 are mounted in a guiding element. The guiding element 149 is pressed into the respective axial bore 145.1, 145.2 and secured with a safety sleeve. A higher pressure is now produced in one of the pressure fields 61.1, 61.2 depending on the direction of rotation 104.1, 104.2. The latter closes the sealing or locking element (ball) of one of the shuttle valves 143.1, 143.2 allocated to this pressure field 61.1, 61.2. The shuttle valve 143.1 allocated to the pressure field 61.1 that is then pressurized with high fluid pressure consequently closes with an operating direction in the first direction of rotation 104.1 and the shuttle valve 143.2 allocated to the pressure field 61.2 that is then pressurized with high fluid pressure consequently closes with an operating direction in the second direction of rotation 104.2.

Leakage oil is produced under pressure in the preferably axially and radially compensated internal gear machine 21 along the axial and radial sealing surfaces. This leakage oil collects in the free surfaces 85 and annular spaces 96, 101.1, 101.2, in particular in the axial washers 58.1, 58.2 (refer to FIG. 4). The leakage oil flows through the radial bores 38.1, 38.2 in the motor pump shaft 23 (refer to FIGS. 2 and 11), which are fluidically connected to the at least one annular space 101.1, 101.2, into the axial discharge bore 102 in the pump shaft 23, also called leakage shaft channel, and from the latter again via the radial bore 113 and via the recesses 133.1, 133.2, 133.3, 133.4, 133.5, also called leakage rotor channels, into the rotor 22.1 or via the annular gap, also called leakage gap channel 137, between the rotor 22.1 and the stator 22.2, concretely between the bandage 135 of the rotor 22.1 and the can 110, which is also called a sealing tube and is fixedly connected to the stator 22.2, back into the connecting space 106. Taking into consideration the preferably very small gap width of this annular gap or leakage gap channel 137 and the multitude of recesses 133.1, 133.2, 133.3, 133.4, 133.5 of the rotor 22.1, also called leakage rotor channels, which also have a comparatively large passage cross section, the largest portion or an important portion of the total leakage oil flows back into the connecting space 106 through the leakage rotor channels 133.1, 133.2, 133.3, 133.4, 133.5. A slight overpressure is produced in this way in the connecting space 106, which in the end opens the shuttle valve 143.1, 143.2 in the low pressure-loaded pressure field 61.1, 61.2 depending on the direction of rotation 104.1, 104.2. A connection between the input side, that is, the system or preload pressure, and the can chamber 107 is produced by means of the open shuttle valve 143.1, 143.2. The preload pressure or system pressure can be lower by several multiples than the working pressure. The stator 22.2 of the motor pump unit 20 and also the two cover or housing parts 25.2, 25.4 can be advantageously cost effectively configured by means of this advantageous arrangement according to the invention of the shuttle valves 143.1, 143.2, since these components do not have to withstand the high working pressure.

The above-described leakage oil guide also ensures that the ball bearing 111 arranged on the motor side is supplied with oil. This bearing 111 is lubricated thereby, the frictional heat is dissipated, and the service life is thus considerably increased. The radial bore 113 ends ahead of the ball bearing 111 on the ball bearing side when observed from the pinion 26 in the shown exemplary embodiment, but is fluidically connected to the bearing gap 155 formed between the inner ring 122.1 and the outer ring 122.2 of the ball bearing 111 (refer to FIGS. 11 and 12), so that a sufficient lubrication as well as a cooling effect is still achieved and the frictional heat is still dissipated. An improvement of the bearing lubrication could be achieved by means of an axial bore, which is not shown in the drawings, as well as an additional radial bore, which is likewise not shown in the drawings, in the bearing mounting screw or sensor screw. These additional bores can be installed in the motor pump shaft 23 in addition or alternatively to, also instead of, the radial bore 113 arranged ahead of the bearing 111 or the bearing mounting screw or sensor screw 112 when observed from the pinion 26. An advantageous forced lubrication of the bearing 111 can be achieved thereby.

Common Shaft:

A motor pump shaft 23 designed as one piece or produced from one piece is represented in the preferred exemplary embodiment shown in the figures. Separate shafts in the form of a pump shaft and a motor shaft can also be provided according to an alternative approach, which is not shown in the figures. Entrainment could take place by means of a spline, for example with a head or foot centering, in order to fix the two shafts. Fixation of the two shafts could also take place via an additional fit between motor and pump shaft. In order to maintain the leakage oil circuit as described above, the motor shaft as well as the pump shaft would then have to have an axial leakage shaft channel or an axial discharge bore, which would have to be mutually fluidically connected.

Bearing Mounting and Sensor Screw:

The bearing mounting and sensor screw 112 is preferably made from non-magnetic material so as not to influence the magnetic signals of the sensor 120. The sensor 120 is mounted, preferably glued, in an axial bore 150 of the bearing mounting and sensor screw 112. The outer diameter of the bearing mounting and sensor screw 112 is greater than the inner diameter of the ball bearing 111 or its inner ring 122.1. An axial fixation of the ball bearing 111 or the motor pump shaft 23 on the ball bearing 111 takes place herewith. The sensor screw 112 is stepped at its outer diameter and encloses the sensor 120 with a thin-walled tubular part 151. This tubular part 151 with sensor 120 projects into a blind bore 152 in the housing or cover part 25.4. The base of the blind bore 152 has a residual wall thickness of a few millimeters, preferably of about 2 mm. The motor pump unit 20 can be pressurized with a high system pressure, preferably of up to 200 bar, by means of this advantageous embodiment of the housing or cover part 25.4. The low residual wall thickness of the base or wall part 153 of the tubular part 151 of the bearing mounting and sensor screw 112 that contains the sensor 120 exerts only a limited influence on the magnetic flow of the sensor 120. The bore 150 in the housing or cover part 25.4 is preferably only slightly larger than the outer diameter of the tubular part 151 of the bearing mounting and sensor screw 112. The surface of the base or wall part 153 of the tubular part 151 that has the low residual thickness pressurized with pressure is ideally kept as small as possible thereby.

What is claimed is:

1. A motor pump unit comprising:

a multi-part housing comprising first, second, and third housing parts;

an internal gear machine comprising:

a working chamber delimited by at least the first and second housing parts;

a pinion gear arranged in the working chamber, rotatably mounted around a pinion rotational axis and having a plurality of pinion teeth;

a hollow gear arranged in the working chamber, rotatably mounted around a hollow gear rotational axis and eccentrically mounted relative to the pinion gear, the hollow gear having a plurality of hollow gear teeth, at least some of which mesh in an engagement area with at least some of the plurality of pinion teeth of the pinion gear;

a sickle-shaped free space provided between the pinion gear and hollow gear, a multi-part filler element arranged in the sickle-shaped space and comprising a plurality of radial sealing segments that are movable relative to each other in a radial direction to radially seal a high pressure area of the working chamber, wherein a first of the plurality of radial sealing segments comprises a pinion segment that abuts against the pinion teeth of the pinion gear, wherein a second of the plurality of sealing segments comprises a hollow gear segment that abuts against the hollow gear teeth of the hollow gear, wherein the pinion segment and the hollow gear segment each have an inner surface that radially faces towards the other segment, respectively, and a radial gap is provided between the inner surface of the pinion segment and the inner surface of the hollow gear segment;

at least one axial sealing plate that is movable in the axial direction and arranged for axially sealing the high pressure area of the working chamber, wherein, on a side of the at least one sealing plate that faces toward faces of the pinion gear and the hollow gear, the at least one axial sealing plate comprises at least one sealing plate depression in a form of a pressurizable sealing plate control channel, the sealing plate control channel starting from a sealing plate recess, being open to the faces of the pinion gear and the hollow gear, open to the radial gap, and located directly opposite the radial gap, wherein a first control groove as well as a second control groove, respectively, are open to the faces of the pinion gear and the hollow gear and end in the sealing plate recess, wherein the first control groove is arranged in the area directly opposite of pinion teeth gaps configured between the pinion teeth of the pinion gear and the second control groove is arranged in the area directly opposite of hollow gear teeth gaps configured between the hollow gear teeth of the hollow gear;

at least one shaft;

an electric motor coupled to the internal gear machine via the at least one shaft and rotatably mounted in the housing around a shaft rotational axis, wherein the electric motor comprises a rotor arranged in the third housing part of the multi-part housing and being rotatable around a rotor rotational axis, and a stator.

2. The motor pump unit according to claim 1, wherein the pinion segment or the hollow gear segment or both the pinion segment and the hollow gear segment comprise at least one radial sealing segment depression in the form of a pressurizable radial sealing segment control channel extending in a peripheral direction around the pinion rotational axis or around the hollow gear rotational axis, being open to the radial gap, and ending directly in the radial gap.

3. The motor pump unit according to claim 1, wherein the sealing plate control channel has a V-shaped cross section when observed in a cross section running parallel to the axial direction.

4. The motor pump unit according to claim 1, wherein the sealing plate control channel extends in the peripheral direction around the pinion rotational axis.

* * * * *